US007654340B2

(12) United States Patent
Self et al.

(10) Patent No.: US 7,654,340 B2
(45) **Date of Patent: *Feb. 2, 2010**

(54) DIRECTIONAL REAMING SYSTEM

(75) Inventors: Kelvin P. Self, Stillwater, OK (US); Floyd R. Gunsaulis, Perry, OK (US); H. Stanley Mullins, Perry, OK (US); Gerald A. Stangl, Stillwater, OK (US); David R. Payne, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 313 days.

This patent is subject to a terminal disclaimer.

(21) Appl. No.: 11/691,304

(22) Filed: Mar. 26, 2007

(65) Prior Publication Data

US 2007/0187148 A1 Aug. 16, 2007

Related U.S. Application Data

(63) Continuation of application No. 10/813,824, filed on Mar. 31, 2004, now Pat. No. 7,195,079.

(60) Provisional application No. 60/459,186, filed on Mar. 31, 2003.

(51) Int. Cl.
*E21B 7/20* (2006.01)

(52) U.S. Cl. ..... 175/53; 175/62

(58) Field of Classification Search ..... 175/45, 175/53, 62, 73, 74, 406, 396, 91, 19, 382, 175/384

See application file for complete search history.

(56) References Cited

U.S. PATENT DOCUMENTS

| | | | |
|---|---|---|---|
| 5,429,198 | A | 7/1995 | Anderson et al. |
| 5,490,569 | A | 2/1996 | Brotherton et al. |
| 5,682,956 | A | 11/1997 | Deken et al. |
| 5,957,222 | A | 9/1999 | Webb et al. |
| 5,979,574 | A | 11/1999 | Osadchuk |
| 6,179,065 | B1 | 1/2001 | Payne et al. |
| 6,244,361 | B1 | 6/2001 | Comeau et al. |
| 6,491,115 | B2 | 12/2002 | Van Houwelingen et al. |
| 6,585,062 | B2 | 7/2003 | Rozendaal et al. |
| 6,607,046 | B1 | 8/2003 | Betts et al. |
| 6,668,946 | B2 | 12/2003 | Rankin et al. |
| 6,732,816 | B2 | 5/2004 | Dimitroff |
| 6,755,263 | B2 | 6/2004 | Alft et al. |
| 7,036,609 | B2 | 5/2006 | Michael et al. |
| 7,086,808 | B2 | 8/2006 | Wentworth et al. |

(Continued)

FOREIGN PATENT DOCUMENTS

| | | | |
|---|---|---|---|
| DE | 4104992 | A1 | 8/1992 |

(Continued)

*Primary Examiner*—Daniel P Stephenson
(74) *Attorney, Agent, or Firm*—Tomlinson & O'Connell, PC

(57) ABSTRACT

A horizontal directional drilling system is used to drive operation of a guidable reamer assembly connected to a drill string. The guidable reamer assembly preferably has a cutting member with a central longitudinal axis and a support member also having a central longitudinal axis. The longitudinal axes of the cutting member and the support member are collinear when the reamer assembly is in the non-steering position and laterally displaced when in the steering position. The assembly and method of this invention provide for increased control of reaming operations and product pipe placement.

45 Claims, 23 Drawing Sheets

U.S. PATENT DOCUMENTS

| | | | | |
|---|---|---|---|---|
| 7,195,079 | B2 * | 3/2007 | Self et al. | 175/53 |
| 7,218,244 | B2 | 5/2007 | Jin et al. | |
| 2002/0020561 | A1 * | 2/2002 | Alft et al. | 175/48 |
| 2002/0096362 | A1 * | 7/2002 | Rankin et al. | 175/26 |
| 2004/0028476 | A1 | 2/2004 | Payne et al. | |

FOREIGN PATENT DOCUMENTS

| | | | |
|---|---|---|---|
| WO | 03100205 | A1 | 12/2003 |

* cited by examiner

DIRECTIONAL REAMING SYSTEM

CROSS REFERENCE TO RELATED APPLICATION

This application is a continuation of U.S. application Ser. No. 10/813,824, filed Mar. 31, 2004, which claims the benefit of U.S. Provisional Application No. 60/459,186, filed on Mar. 31, 2003, the contents of which are incorporated herein fully by reference.

FIELD OF THE INVENTION

The present invention relates to improved method and apparatus for creating horizontal underground boreholes, in particular horizontal underground boreholes having a close tolerance on-grade sloped or horizontal segment—such as for installation of gravity-flow storm drainage and wastewater sewer pipes. More specifically, the present invention straightens or maintains the desired slope of the borehole during upsizing to accommodate the pullback installation of product pipe.

SUMMARY OF THE INVENTION

The present invention is directed to a guidable reamer assembly for use in horizontal directional drilling operations. The reamer assembly comprises a cutting member having a central longitudinal axis, a support member having a central longitudinal axis, and a steering assembly. The steering assembly is moveable between a steering position and a non-steering position. Further, the steering assembly is adapted to laterally offset the central longitudinal axis of the cutting member from the longitudinal axis of the support member when the steering assembly is in the steering position.

The present invention further includes a horizontal directional drilling system used to make a generally horizontal borehole. The system comprises a rotary drive system, a drill string having a first end and a second end, and a reamer assembly. The first end of the drill string is operatively connected to the rotary drive system. The reamer assembly comprises a cutting member having a central longitudinal axis, a support member having a central longitudinal axis, and a steering assembly. The cutting member is operatively connectable with the drill string for rotation therewith. The steering assembly is moveable between a steering position and a non-steering position and adapted to laterally offset the central longitudinal axis of the cutting member from the longitudinal axis of the support member when the steering assembly is in the steering position.

The present invention also includes a method for steering a reamer assembly within a borehole with a horizontal directional drilling system using a reamer assembly. The reamer assembly comprises a cutting member having a longitudinal axis and a support member having a longitudinal axis. The method comprises detecting the position and orientation of the reamer assembly, laterally displacing the longitudinal axis of the cutting member relative to the longitudinal axis of the support member, and selectively rotating and advancing the cutting member for a segment of axial advance.

The present invention further includes a method for steering a reamer assembly along a desired borepath with a horizontal directional drilling system using a reamer assembly. The reamer assembly comprises a cutting member having a longitudinal axis and a support member having a longitudinal axis. The method comprises establishing the desired borepath, selectively rotating and advancing the reamer assembly along an actual borepath, and detecting the position and orientation of the reamer assembly on the actual borepath relative to the desired borepath to determine a deviation of the reamer assembly from the desired borepath. The method further includes automatically displacing the longitudinal axis of the cutting member laterally relative to the longitudinal axis of the support member for a segment of axial advance of the reamer assembly to return the reamer assembly to the desired borepath.

The present invention includes a guidable reamer assembly for use in horizontal directional drilling operations. The reamer assembly comprises a cutting member that has a central longitudinal axis, a support member that also has a central longitudinal axis, and a steering assembly. The steering assembly is moveable between a steering position and a non-steering position and adapted to laterally offset the central longitudinal axis of the cutting member from the longitudinal axis of the support member when the steering assembly is in the steering position.

BRIEF DESCRIPTION OF THE DRAWINGS

FIG. 1 illustrates a rotary drive system acting on an uphole end of a drill string. The drill string is shown supporting a guidable reamer and an above-ground tracker used to monitor the position and orientation of the guidable reamer.

FIG. 6 is a sectional view of the guidable reamer assembly of FIG. 5. FIG. 6 shows a close-up view of the steering assembly in the steering position.

FIG. 8*a* shows the steering assembly in a non-steering position.

FIGS. 9*a-d* are a series of diagrammatic representations of the guidable reamer assembly of FIG. 1, illustrating the correction of a pre-existing deviation in the borehole.

FIG. 18 is a diagrammatic representation product pipe that it is being drawn into the borehole. FIG. 18 illustrates the use of a laser guidance system disposed within the product pipe.

DESCRIPTION OF THE PREFERRED EMBODIMENTS

Figure 1:
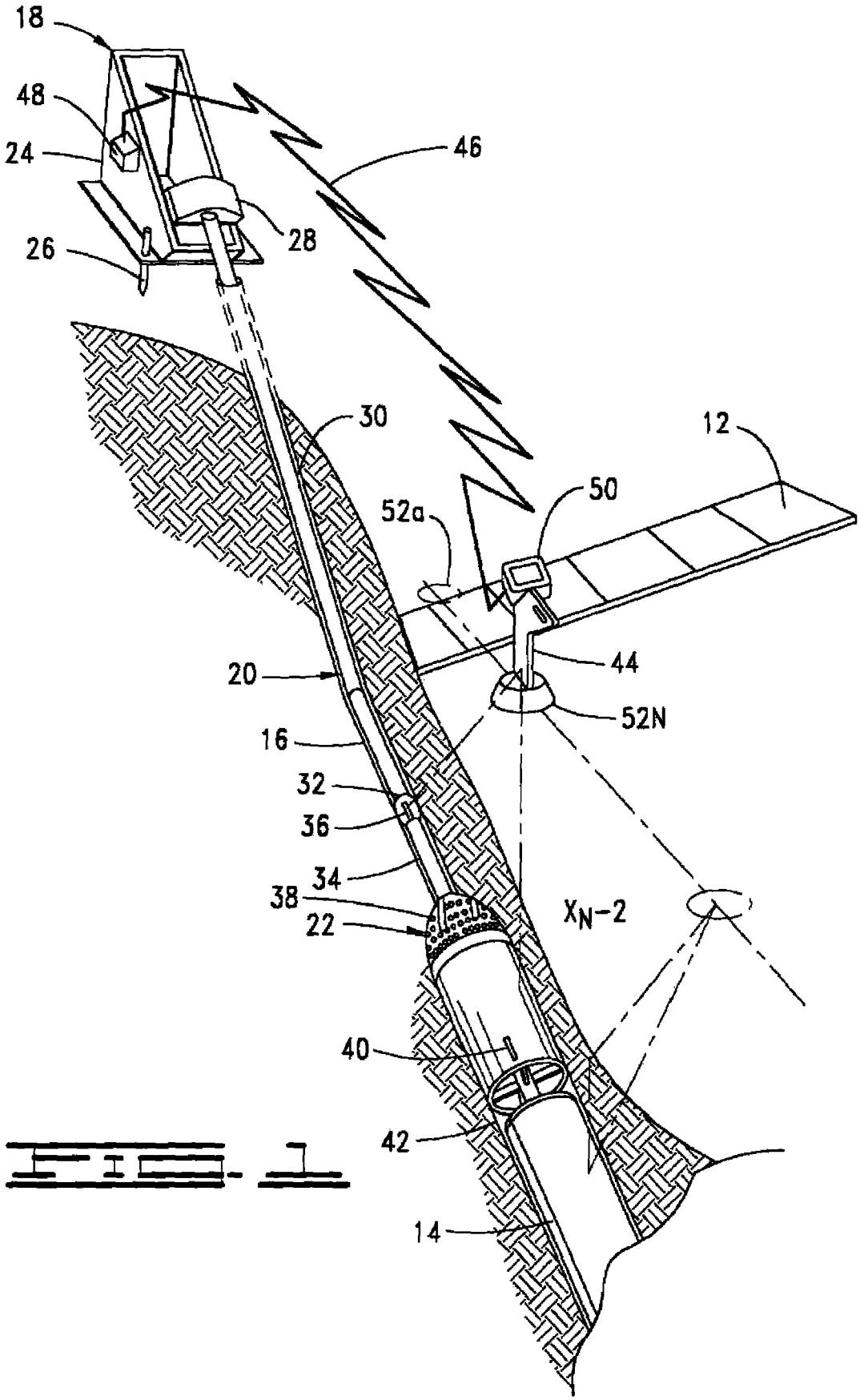
FIG. 1 is a diagrammatic representation of a horizontal directional drilling system constructed in accordance with the present invention.

Turning now to the drawings in general, and FIG. 1 in particular, there is shown therein a horizontal directional drilling ("HDD") system 10 for near-horizontal subsurface placement of utility services in a wide variety of applications, such as beneath a street or roadway 12. HDD system 10 is particularly suited for close-tolerance installations of product pipes 14 such as on-grade gravity-flow storm drainage and wastewater sewer pipes. Close-tolerance lateral control during the upsizing of a borehole 16, also practical with HDD system 10, is advantageous in applications other than gravity-flow. For instance, close-tolerance lateral control of product (i.e., utility services such as pipes and cables) installations can be advantageous where the available easement corridor for utility service placement is of restricted width, or when other utility services already reside within the corridor.

It should be understood that the references to product pipe 14 hereafter are not limiting upon the utility of the present invention. As explained above, the HDD system 10 is well suited for the installation of a variety of "product". It should also be clear that the reaming system and tracking system described below in relation to FIG. 1 are each a particular example, serving to illustrate how the functional aspects of the invention may be implemented.

HDD system 10 comprises the rotary drive system 18 operatively connected by the drill string 20 to a borehole enlarging arrangement such as a guidable reamer assembly 22. Rotary drive system 18 may comprise a frame 24, held in position by earth anchors 26, and a movable carriage 28. The rotary drive system 18 is operatively connected to the uphole end 30 of drill string 20. Drill string 20 may comprise a dual-member drill string. Rotary drive system 18 may comprise dual-spindles connectable thereto. HDD system 10 may further comprise one or more centralizers 32 assembled into or onto drill string 20, toward its downhole end 34, the optimal position of centralizer 32 is no more than twenty (20) feet forward of the guidable reamer assembly 22. For purposes later described, one or more centralizers 32 may be adapted to contain appropriate sensors and an electronic transmitter (a.k.a. a beacon or sonde) 36.

Centralizer 32 may be bearing mounted onto drill string 20 to hold beacon 36 substantially independent of drill string rotation, and its cylindrical-like exterior may comprise longitudinal grooves or spiral fluted channels that allow the passage of drilling fluid that may be attempting to flow through borehole 16. When centralizer 32 is not used, beacon 36 or other useful sensor-transmitters may be placed forward of the reamer by inclusion of an appropriate signal-emissive housing assembled into or onto drill string 20.

It is to be understood that the borehole 16 may be step-wise upsized in one or more reaming passes through the borehole—by utilizing increasingly larger diameter guidable reamer assemblies 22—culminating in the product pipe 14 installation pass, after being initially drilled by utilization of a downhole directional drilling assembly at the downhole end 34 of the drill string 20.

The guidable reamer assembly 22 is suited for correcting borehole alignment variations not exceeding the annular diametrical clearance between drill string 20 and borehole 16, and for counteracting transverse forces exerted by factors such as gravity, soil stratifications and rocks or similar obstacles encountered non-symmetrically across a cutting member 38 of guidable reamer assembly 22. Representative HDD directional drilling tools, systems and methods suitable for drilling borehole 16 in close proximity to the desired installed position of product pipe 14 are disclosed in provisional patent application Ser. No. 60/429,097 filed on Nov. 26, 2002 entitled: "System for Using Multiple Beacons in a Boring Tool" and in commonly-assigned U.S. patent application Ser. No. 10/210,195 entitled: "Two-Pipe On-Grade Directional Boring Tool and Method", both incorporated herein by reference. It should be understood that larger alignment variations than described above for the initial borehole 16 may be overcome by utilizing the stepwise manner for increasing the borehole diameter in two or more passes with correspondingly larger sizes of guidable reamer assembly 22. The increased diameter of borehole 16 on the second and subsequent passes yields greater annular clearance around drill string 20, allowing greater deployment of the steering aspect of guidable reamer assembly 22 in the manner yet to be described.

HDD system 10 further comprises a reamer beacon assembly 40 suitable for verifying that upsized borehole 42 is progressing along its desired path. The reamer beacon assembly 40 may comprise known sensors and transmitters used to sense the orientation of the support member 82 of guidable reamer assembly 22 and to transmit a signal indicative of the orientation of the support member.

A monitoring system 44 may be used above ground to receive the signals transmitted by the beacon assemblies 36 and 40. The monitoring system 44 may comprise a transmitter (not shown) that conveys the information transmitted from the beacon assemblies 36 and 40 via a monitoring system signal 46 to a control system 48 of the HDD system 10.

Beacon assemblies 36 and 40 may contain one or more sensor assemblies (not shown) for measuring information representative of one or more of three angular orientations: roll, pitch (a.k.a. inclination and grade) and yaw (a.k.a. left-right heading and azimuth) of their respective signal-emissive housings within centralizer 32 and guidable reamer assembly 22. Preferably, the beacon assemblies 36 and 40 and their internal sensors are maintained rotationally indexed and in parallel axial alignment with respect to the central axis of each downhole component or assembly that houses them.

One skilled in the art can appreciate, however, that residual non-parallelism can be removed through system calibration and electronic compensation after placement in their respective signal-emissive housings. Sensors for orientation determination may comprise a variety of devices, including: inclinometers, accelerometers, magnetometers and gyroscopes. This orientation information may be conveyed by the respective signals transmitted by the beacon assemblies 36 and 40 to the above-ground monitoring system 44.

The monitoring system 44 may be comprised of a plurality of magnetic field sensors (not shown) used to detect the signals emitted by beacon assemblies 36 and 40. Additionally, the monitoring system 44 may have appropriate amplification and filtering for the outputs of each magnetic field sensor, a multiplexer, an A/D converter, a processor, a display 50, a wireless communications link, batteries, software/firmware, and other items necessary for system operation, as well as useful accessories (not shown) such as a geographical positioning system. The plurality of magnetic field sensors within monitoring system 44 may further be arranged as two orthogonal sets of three sensors, the sets being vertically or horizontally separated. The throughput of the multiplexer and A/D converter may be designed sufficiently high that the digital representations of the magnetic field vector components sensed by the plurality of magnetic field sensors are satisfactorily equivalent to being measured at the same instant of time.

As later described, one or more additional beacon assemblies may be disposed within the product pipe 14—or, alternately, an in-pipe alignment sensing arrangement—to sense and direct the desired alignment of product pipe 14 while it is being installed. The monitoring system 44 is further described in the above-referenced provisional patent application Ser. No. 60/429,097 and in U.S. patent application Ser. No. 10/318,288 entitled: "Apparatus and Method for Simultaneously Locating a Fixed Object and Tracking a Beacon" filed Dec. 12, 2002, the contents of which are incorporated herein by its reference.

Continuing with FIG. 1, monitoring system 44 is positioned at a reference placement station 52*a*, one of a series of reference placement stations $\mathbf{52}_a$ through $\mathbf{52}_n$ on the ground surface in approximate parallel alignment with the path of previously completed borehole 16, but potentially offset to one or the other side by the respective distances Xa through Xn. These offset distances may be substantially similar, for instance within 5 to 10% of each other, though not required. Although also not required, the reference placement stations 52*a* through 52*n* may be the same stations as were established for the creation of borehole 16. Whenever the guidable reamer assembly 22 reaches one of the points 52*a* through 52*n*, the monitoring system 44 may be repositioned at the next adjacent reference station 52.

When utilizing multiple beacon assemblies in close proximity, their respective transmission frequencies must be sufficiently distinct, but within the range of frequencies suitable for HDD applications. Frequency separation and/or improved filtering are techniques for minimizing cross-talk between beacon assemblies positioned in close proximity (less than 10 feet of separation) that transmit to one monitoring system 44. In this arrangement, frequencies within an approximate 8 kHz to 40 kHz range may be suitably distinct to prevent undo cross-talk between respective spatially separated beacon assemblies when their transmitting frequency separation is on the order of 4 kHz to 10 kHz. For example, the frequencies of 25 kHz and 29 kHz are suitably distinct without improved filtering.

Distinct frequency signals emitted by beacon assemblies 36 and 40 may be received and processed by monitoring system 44 to determine the position of various downhole components or assemblies of HDD system 10. Information from any orientation sensors that may comprise one or more of the beacon assemblies is conveyed via the respective signal transmission of each beacon assembly 36 and 40 and decoded by monitoring system 44 to obtain useful angular orientations of each downhole component or assembly that houses the respective beacon assembly.

The monitoring system 44 may comprise a processor (not shown) that is capable of producing a composite of the relative positions of the beacon assemblies 36 and 40 with respect to the monitoring system 44. For instance, the antennas arrays (not shown) within monitoring system 44 may measure the composite magnetic field components emanating from the beacons 36 and 40 in three planes. The measured magnetic field components are separated by the processor into the distinct vector components of each beacon assembly's frequency through the utilization of DSP filters and detectors (not shown). The separate vector summation of each set of the resolved magnetic field vector components for each beacon assembly determines its respective total field sensed by the respective antenna arrays of monitoring system 44. The angles from each antenna array to each beacon assembly 36 and 40 may be determined by ratioing each total field to its resolved magnetic field vector components. The distances between each antenna array and each beacon can be determined from these sets of angles and the known distance between the antenna arrays by utilizing the law of cosines. These "straight line" distances may then be converted to the above-mentioned position (x, z) and depth (y) components. Such an arrangement allows determination of the respective beacon positions without monitoring system 44 being directly overhead, while also receiving of their orientation sensor information. The known coordinates of the presently occupied reference placement station 52 allow these positions and orientations to be transformed into a global coordinate system for comparison to the desired path of borehole 16.

With continued reference to FIG. 1, monitoring system 44 relays information to the control system 48 of the HDD system 10 using the monitoring system signal 46. Information may be communicated in a bi-directional manner between monitoring system 44 and control system 48 of HDD system 10 to achieve the desired placement of product pipe 14. Preferably, this information is gathered and exchanged during operation in what may be referred to as a measurement-while-drilling (MWD) manner—herein meaning a "measurement-while-reaming" manner.

The operation of HDD system 10 and its guidable reamer assembly 22 may be controlled through automated operation of various functions comprising the reaming operation. To do so, the control system 48 interfaces with the various components and functions of the drilling machine 10, automatically operating and coordinating the operations of those components and functions utilized during backreaming operations. Those components and functions may include, for instance, the movement of carriage 28 along frame 24 for purposes such as extending or retracting drill string 20, the rotation or non-rotation of the drill string through control of rotary drive system 18, flow control of drilling fluid into borehole 16, adding or removing pipe sections to/from drill string 20, and related operations of the HDD system 10.

During automated operation, the control system 48 obtains, monitors, and communicates data representative of the operations of the HDD system 10, and operates the rotary drive system 18 in response to received data. An operator may only be required to start the HDD system 10 and intervene when an operation is complete or when the system operates out of its tolerance range. Such an automated control system is disclosed in commonly assigned U.S. patent application Ser. No. 09/481,351, the contents of which are incorporated herein by reference. As used herein, automated operation is intended to refer to operations that can be accomplished without operator intervention and within certain predetermined tolerances. (Automated control of the reaming operation is further described with respect to FIGS. 20-21.) Alternatively, a system of manual levers, switches or similar controls may be utilized for operational control of rotary drive system 18 and guidable reamer assembly 22.

With continued reference to FIG. 1 and as previously discussed, beacon assembly 36 may comprise one or more sensors adapted to sense the orientation of the centralizer 32. One such sensor may be a pitch sensor arranged within the beacon assembly 36 to sense the pitch orientation of the centralizer 32 within borehole 16. Sensing variations in the pitch of centralizer 32 as it advances through borehole 16 is useful in detecting undesired irregularities in the grade of borehole 16 prior being encountered by guidable reamer assembly 22. Similarly, a yaw sensor within beacon assembly 36 would be useful for detection of undesired left-right alignment variations along borehole 16. MWD monitoring of the location—i.e., position (x, z) in the horizontal plane and depth (y)—of beacon assembly 36 via monitoring system 44 may also be useful for these purposes. In either instance, it is advantageous to hold centralizer 32 substantially without rotation with respect to drill string 20. In the instance of location monitoring, it is further advantageous to sense the rotational position angle of beacon assembly 36 within the cross-section of borehole 16, for instance with a roll sensor (not shown). Advance knowledge of existing alignment variations in borehole 16 detected via beacon assembly 36 may be input to control system 48. This allows the guidable feature of guidable reamer assembly 22 to be deployed before a borehole alignment variation is engaged.

Alternately, centralizer 32 may be omitted from drill string 20. In this case, a location database archived during the creation of the borehole 16 may provide the advance knowledge. This "as-drilled" positional information (sometimes referred to as an "as-built" map) may be compared to the desired placement positional information for product pipe 14 to determine the segments along borehole 16 where path corrections will be necessary. The approach of the guidable reamer assembly 22 to the locations where deployment of its steering feature will be required may be determined, for example, by monitoring the length of drill string 20 withdrawn from borehole 16 by the rotary drive system 18. (Described later with respect to FIG. 20.) Apparatus suitable for monitoring the length of drill string 20 withdrawn from the borehole 16 is disclosed in the previously referenced U.S. patent application Ser. No. 09/481,351 and in the commonly-assigned U.S. Pat. No. 6,179,065 entitled: "System and Method for Automatically Controlling a Pipe Handling System for a Horizontal Boring Machine", incorporated herein by its reference.

Within the preferred range of alignment variances given earlier above for borehole 16, the HDD system 10 is functional even in absence of advance information. For instance, beacon assembly 40 may be utilized—in much the same manner as described above with respect to beacon assembly 36—to detect reactionary changes in the alignment of the guidable reamer assembly 22 resulting from its cutting member 38 engaging a borehole alignment variation, a soil stratification, a non-symmetric object, or the like. The necessity to counteract the forces of gravity and/or buoyancy acting on guidable reamer assembly 22 and product pipe 14 may also be sensed through the monitoring of reamer beacon assembly 40 and, when also present, the above-mentioned additional beacon(s) or alignment-sensing arrangement within the product pipe 14.

A commonly known "pre-cutter" (not shown) may be placed between drill string 20 and cutting member 38. A pre-cutter having a diameter larger than the borehole 16 can aid in keeping an open channel for the flow of slurried cuttings. A pre-cutter may also provide a straightening effect to any borehole variations just prior to their engagement with the cutting member 38. The straightening effect can be enhanced by extending the pre-cutter section to encompass the majority of the interval between the cutting member 38 and centralizer 32.

Figure 2:
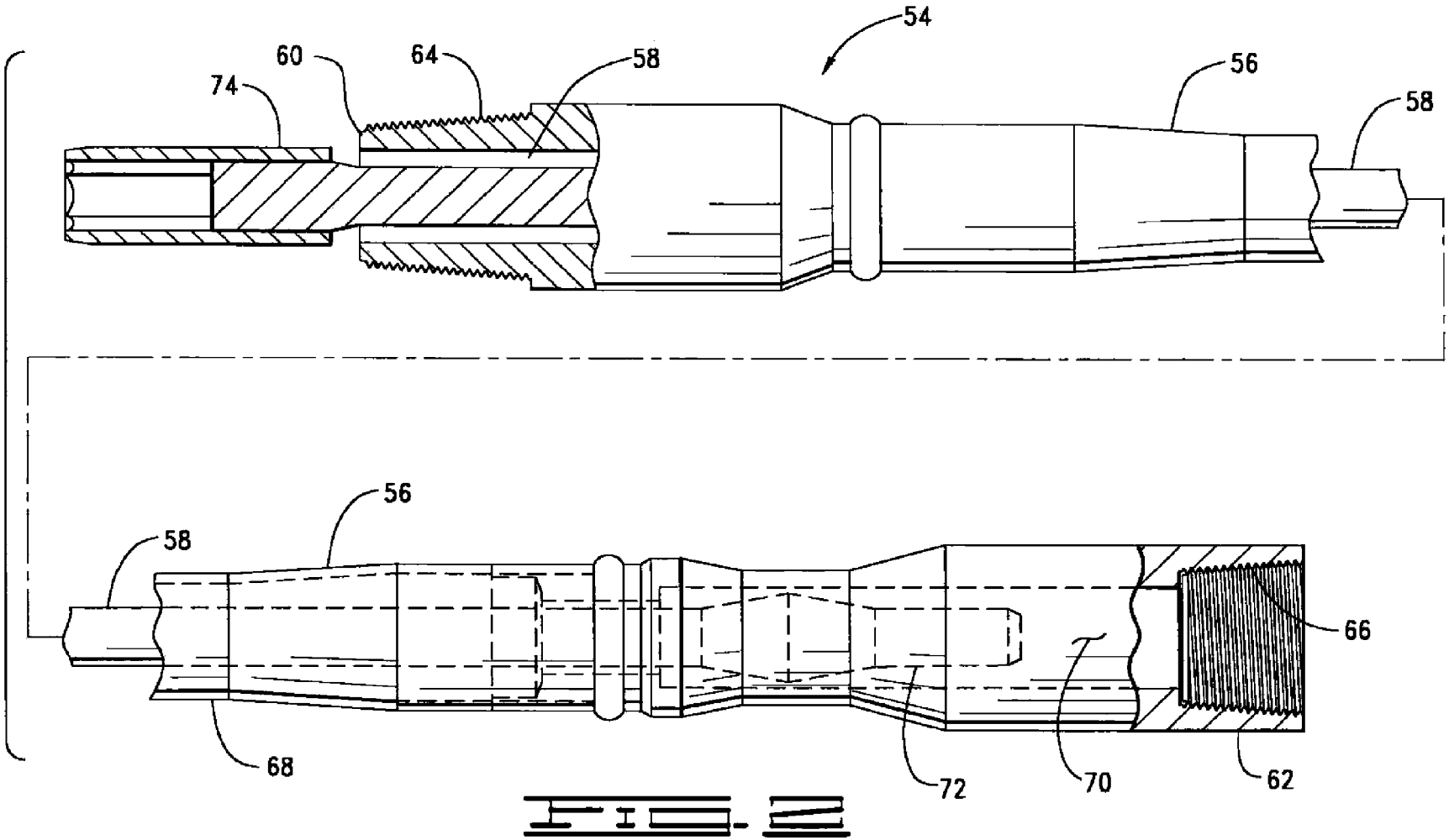
FIG. 2 shows a side elevational, partly sectional view of a pipe section used with a dual-member drill string.

Turning now to FIG. 2, there is shown therein one of a plurality of dual-member pipe sections 54 comprising the drill string 20 (FIG. 1). The dual-member pipe section 54 comprises a hollow outer member 56 and an inner member 58 positioned longitudinally therein. The inner member 58 and outer member 56 are connectable with the inner members and outer members of adjacent dual-member pipe sections to form the drill string 20. The interconnected inner members 58 are independently rotatable of the interconnected outer members 56 to drive operation of the guidable reamer assembly 22 (FIG. 1). It will be appreciated that any dual-member pipe section capable of connecting to adjacent sections of dual-member pipe may be used, but for purposes of illustration, a discussion of a preferred dual-member pipe section 54 follows.

The outer member 56 is preferably tubular having a pin end 60 and a box end 62. The pin end 60 and the box end 62 are correspondingly threaded. The pin end 60 is provided with tapered external threads 64, and the box end 62 is provided with tapered internal threads 66. Thus, the box end 62 of the outer member is connectable to the pin end 60 of a like dual-member pipe section 54. Similarly, the pin end 60 of the outer member 56 is connectable to the box end 62 of a like dual-member pipe section 54.

The external diameter of the pin end 60 and the box end 62 of the outer member 56 may be larger than the external diameter of the central body portion 68 of the outer member 56. The box end of the outer member 62 forms an enlarged internal space 70 for a purpose yet to be described.

The inner member 58 is preferably elongate. Preferably, the inner member 58 is integrally formed and comprises a solid rod. However, it will be appreciated that in some instances a tubular inner member 58 may be satisfactory.

Continuing with FIG. 2, the inner member 58 of the dual-member pipe section 54 is provided with a geometrically-shaped pin end 72 and with a box end 74 forming a geometrically-shaped recess corresponding to the shape of the pin end of the inner member 58. As used herein, "geometrically-shaped" denotes any configuration that permits the pin end 72 to be slidably received in the box end 74 and yet transmit torque between adjacent pipe sections 54. The geometrically-shaped pin end 72 and box end 74 prevent rotation of the pin end relative to the box end when thus connected. A preferred geometric shape for the pin end 72 and box end 74 of the inner member 58 is a hexagon. The box end 74 of the inner member 58 may be brazed, forged or welded or attached to the inner member 58 by any suitable means.

The box end 74 of the inner member 58 is disposed within the box end 62 of the outer member 56. It will now be appreciated why the box end 62 of the outer member 56 forms an enlarged internal space 70 for housing the box end 74 of the inner member. This arrangement facilitates easy connection of the dual-member pipe section 54 with the drill string 20 and the rotary drive system 18.

Figure 3:
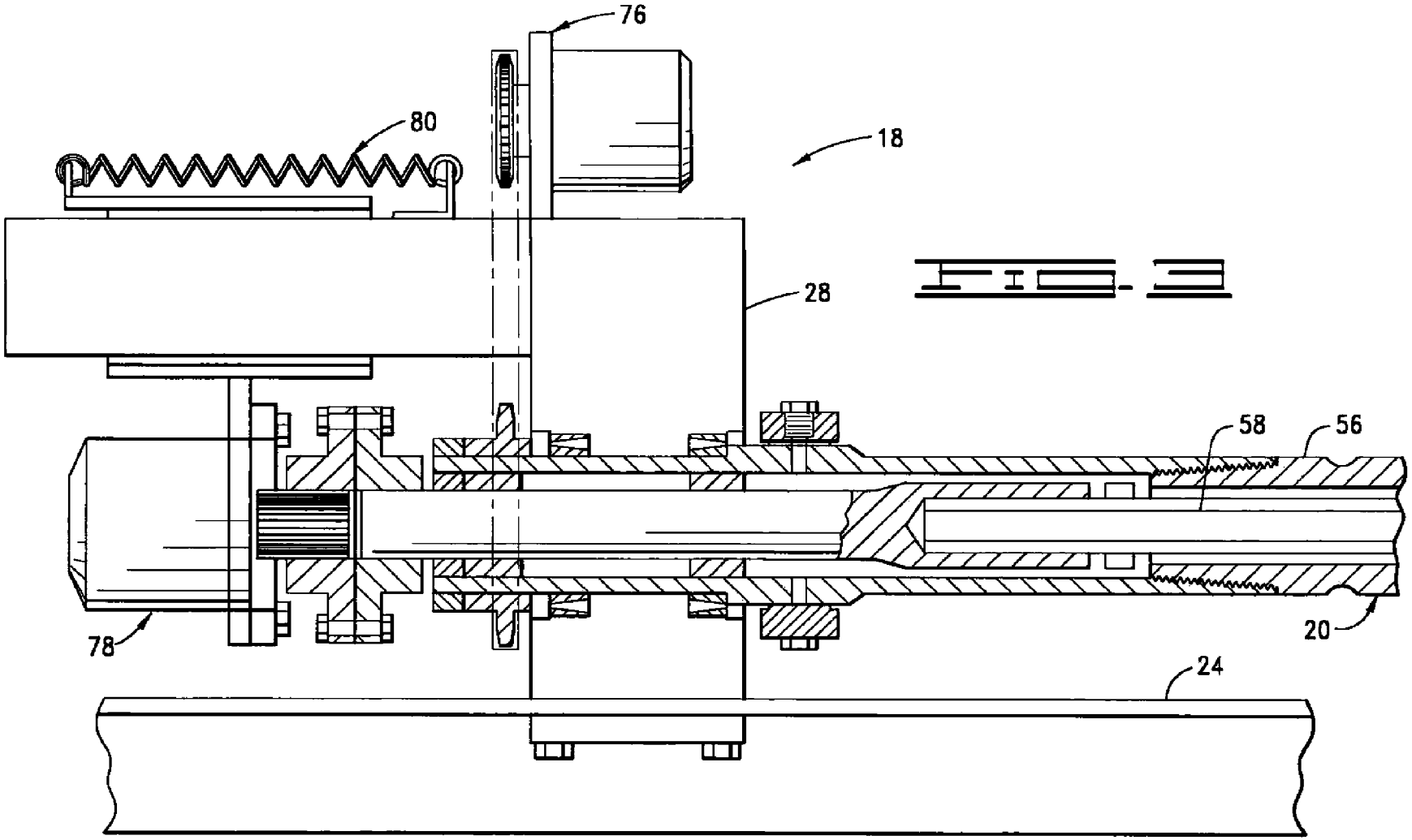
FIG. 3 is a side elevational, partly cross-sectional view of the rotary drive system of the present invention.

Turning now to FIG. 3, the rotary drive system 18 for driving operation of the guidable reamer assembly 22 (FIG. 1) is shown in more detail. The rotary drive system 18 shown in FIG. 3 is adapted to drive axial advancement and rotation of both the interconnected outer members 56 and interconnected inner members 58 of the drill string 20. Because the interconnected inner members 58 and interconnected outer members 56 of the drill string 20 rotate independently of each other, the rotary drive system 18 of FIG. 3 has two independent drive groups for independently driving the interconnected outer members and interconnected inner members.

The rotary drive system 18 thus preferably comprises a carriage 28 supported on the frame 24. Supported by the carriage 28 is an outer member drive group 76 for driving the interconnected outer members 56, and an inner member drive group 78 for driving the interconnected inner members 58. The rotary drive system 18 also comprises a biasing assembly 80 for urging engagement of the inner members 58. A suitable rotary drive system 18 having an outer member drive group 76 for driving the interconnected outer members 56 and inner member drive group 78 for driving the interconnected inner members 58 is disclosed in more detail in U.S. Pat. No. 5,682,956, the contents of which are incorporated herein by reference.

Figure 4:
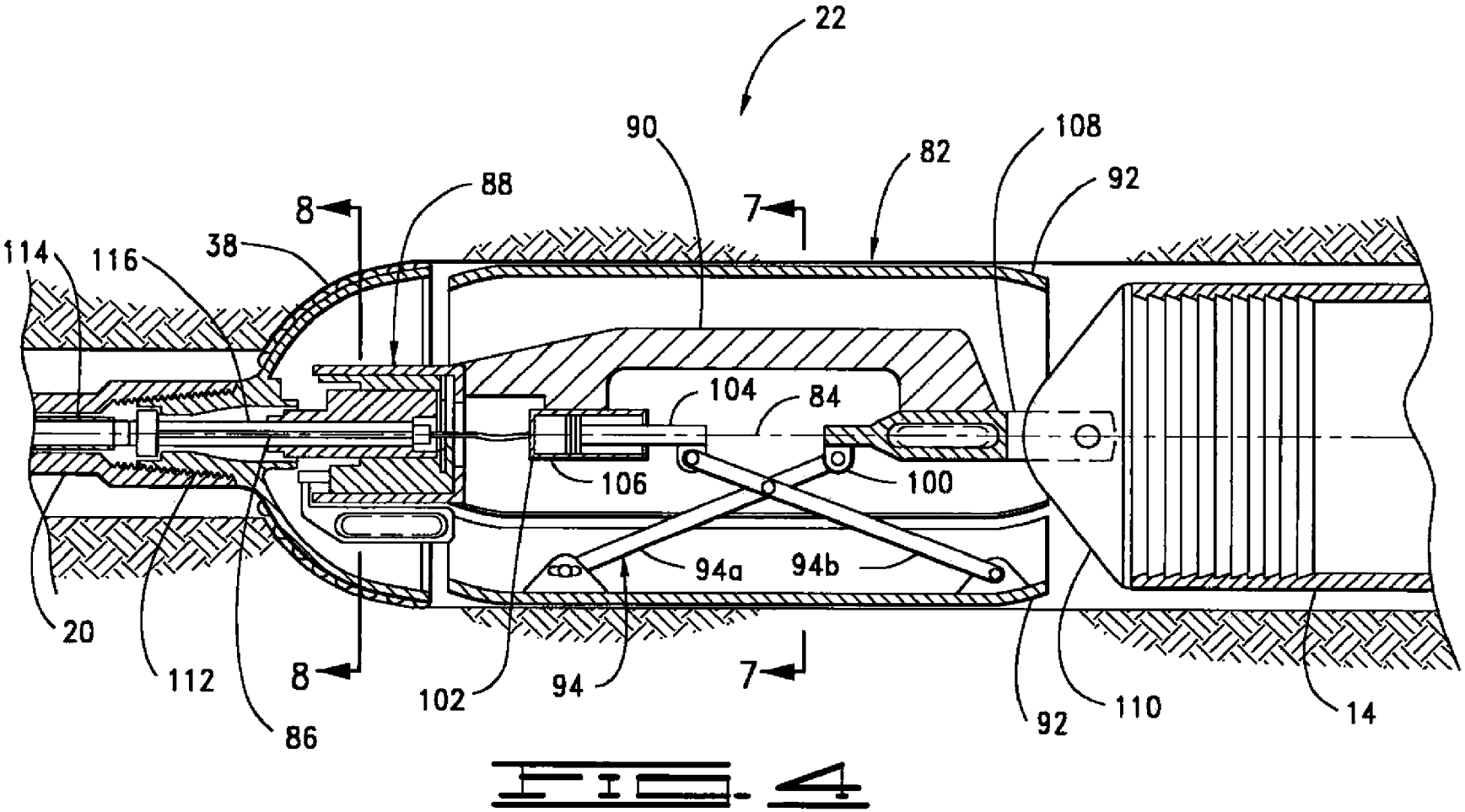
FIG. 4 is a partly sectional view of the guidable reamer assembly connected to the downhole end of the drill string and in a non-steering position.

With reference now to FIG. 4, shown therein is the guidable reamer assembly 22, usable to enlarge borehole 16 (FIG. 1) for the installation of product pipe 14. Guidable reamer assembly 22 may comprise the cutting member 38 and a support member 82 having a central longitudinal axis 84. The cutting 38 member has a central longitudinal axis 86 and is operatively connectable with the drill string 20 for rotation therewith. The guidable reamer assembly 22 also comprises a steering assembly 88 moveable between a steering position and a non-steering position. The steering assembly 88 is adapted to laterally offset the central longitudinal axis 86 of the cutting member 38 from the longitudinal central axis 84 of the support member 82.

The outer diameter of the support member 82 is preferably reduced at its leading and trailing ends to ease its movement into the enlarged borehole 42 created by cutting member 38. It will be appreciated that the length of the support member 82 should be such that negotiating the guidable reamer assembly 22 along the curved bore path extending from the ground surface to the intended product pipe 14 installation depth may be accomplished.

The support member 82 may further comprise a frame 90, with a plurality of borehole engaging members 92 supported by the frame. As shown in FIG. 4 the frame 90 of the support member is adapted to support the steering assembly 88. The borehole engaging members 92 supported by frame 90 are adapted to limit rotation of the support member 82 within the enlarged borehole 42. The borehole engaging members 92 may comprise longitudinally knife-edged, grooved, ribbed or otherwise roughened outer surface (not shown) enhance the anti-rotation effect. As will be further described, this anti-rotation feature may be useful toward the setting and holding of a desired steering orientation for guidable reamer assembly 22. The support member 82 comprising borehole engaging members 92 is radially expandable—thereby holding the central axis 84 of the support member 82 in approximate coincidence with the centerline of borehole 42.

Figure 7:
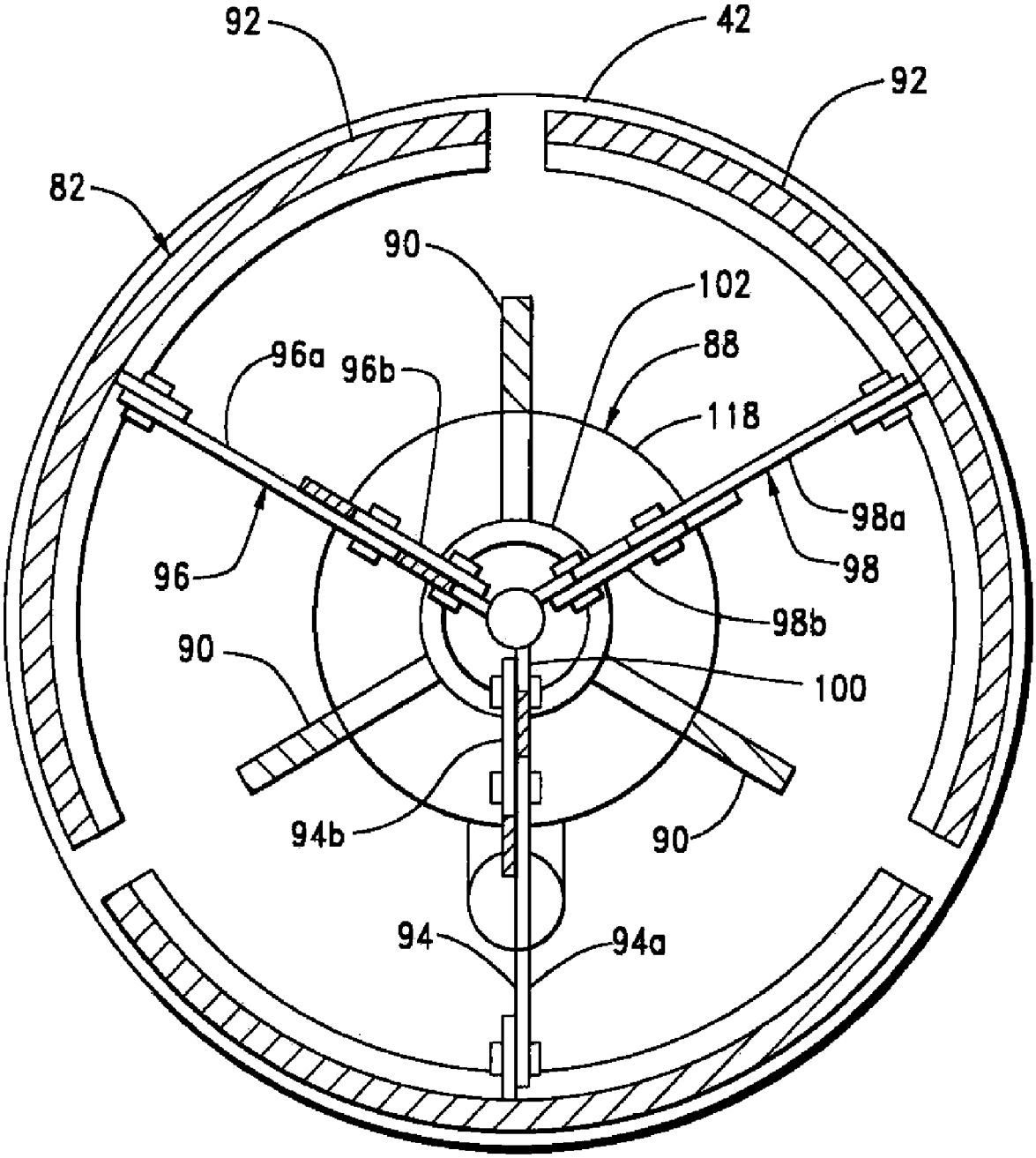
FIG. 7 is a cross-sectional view of the guidable reamer assembly taken along line 7-7 of FIG. 4.

With reference to FIGS. 4 and 7, the borehole engaging members 92 may be radially expanded using a scissor linkages 94, 96, and 98. The scissor linkages 94, 96 and 98 may comprise links 94*a*-94*b*, 96*a*-96*b* and 98*a*-98*b* attached to the frame 90 and the borehole engaging members 92. The anchorage of each "a" link is operatively connected to its respective borehole engaging member 92. The opposite end of each "a" link is connected to an anchor point 100 on the frame 90. The opposite end of each "b" link is acted upon by a linear actuator 102 such as the extendable rod 104 of hydraulic cylinder 106. Anchor point 100 and the hydraulic cylinder 106 are supportable by the central frame 90. As illustrated in FIG. 4, drilling fluid pumped down drill string 20 may be utilized for this purpose. However, a number of other techniques would be suitable for powering this action. It will be appreciated that other linear actuators and power sources may be utilized, for instance a battery or downhole generator powered electrically-driven ball screw to drive actuation of the scissor linkages. Initiation may be through valving (not shown) controlled by one of several well-known techniques, such as: a step change in the flow of drilling fluid, or wireless signals transmitted from automatic controller 48 (FIG. 1) or monitoring system 44 (FIG. 1). The frame 90 may further comprise a pipe pulling link and swivel 108 for connection to pipe pulling cap 110, thereby allowing product pipe 14 to be pulled into upsized borehole 42 without being subjected to excessive twisting.

Guidable reamer assembly 22 is attached to the downhole end of outer drill string member 56 by way of threaded connection 112, or other commonly known push-pull and torque-transmitting attachment means. Thus, the rotation of cutting member 38 is accomplished with and controlled by outer member drive group 76 (FIG. 3). Geometrically shaped female connection 114 connects inner drill string member 58 to a shaft 116. The shaft 116 is bearing mounted within the pin portion of threaded connection 112. Tapered roller bearings, or other push-pull resisting bearing arrangements, prevent axial displacement of inner shaft 116 with respect to the pin portion of threaded connection 112, thereby holding the cutting member 38 and the support member 82 in assembly (further described later).

Referring now to FIGS. 4 and 6 the steering assembly 88 will be discussed in greater detail. FIG. 6 is a close-up view of the steering assembly 88 in the steering position shown in FIG. 5. The steering assembly may comprise a housing 118 and the shaft 116. The shaft 116 is operatively connectable to the inner member 58 of the drill string 20. The second end of the shaft 116 is supported within the housing 118. Movement of the inner shaft moves the steering assembly 88 between the steering position shown in FIGS. 5 and 6 and the non-steering position shown in FIG. 4.

The steering assembly 88 may further comprise and outer eccentric cam 120 and an inner eccentric cam 122 supported within the housing 118. The inner eccentric cam 120 is disposed within the outer eccentric cam 120 for movement therein. The inner eccentric cam 122 may be keyed to shaft 116 and therefore rotationally indexable by inner drill string member 58 and its drive group 78 (FIG. 3). Both clockwise and counter-clockwise rotation are practical through its geometrically shaped connectors 114 (FIG. 4). Outer eccentric cam 120 radially surrounds inner eccentric cam 122 in a mutually restraining axial relationship—held there, for example, by split-in-half ring 124 and the threading of gland nut 126 into the distal end of outer eccentric cam 120. Their assembly is supported within housing 118 by retaining cover 128.

In the operational position illustrated in FIG. 6, outer eccentric cam 120 is rotatable within housing 118. In at least one alternate operational position (shown in FIG. 4) outer eccentric cam 120 is not so rotatable. Further, in one direction—for instance clockwise (CW) as viewed from behind drilling machine 18—the inner eccentric cam 122 may be freely rotated with respect to outer eccentric cam 120, whereas in the opposite direction the two eccentrics rotate in unison—the resulting action is accomplished, for example, through a one-way clutch 130 bearing arrangement positioned between the outer eccentric cam 120 and the inner eccentric cam 122. It will be appreciated that other types of clutches and forms of actuation may be utilized wherein counter-clockwise rotation of inner drill string member 58 is not required. Such an approach would be advantageous where the inner drill string member 58 is comprised of threadably-connected pipe segments. The relative rotational orientation between inner eccentric cam 122 and outer eccentric cam 120 may be indicated by one of several types of rotary encoders or sensors (not shown) applied across (or, in some cases, on) their circular contact interface.

The retaining cover 128 and outer eccentric may comprise a jaw clutch 132. The retaining cover 128 may comprise a mating half 132*a* of the jaw clutch 132, the other mating half 132*b* may be fixed to the outer eccentric cam 120. Housing 118, of the present embodiment, is constructed longer in length than outer eccentric cam 120 to allow disengagement of jaw clutch 132, as depicted in FIG. 6. This disengagement may be created as follows: a short forward movement of carriage 28 applies thrust through drill string 20 such that cutting member 38 retreats from its upsizing engagement with borehole 16. The mating half 132*b* of jaw clutch 132 attached to outer eccentric cam 120 moves in concert axially with cutting member 38. However, axial movement of housing 118 is inhibited by the engagement of support member 82 with borehole 42. Thus outer eccentric cam 120 slides axially within housing 118 sufficiently for separation of the mating halves 132*a* and 132*b*. (It may be further noted, that the purposeful gap between the support member 82 and the rear of the cutting member 38 narrows as disengagement of jaw clutch 132 is accomplished.)

Figure 5:
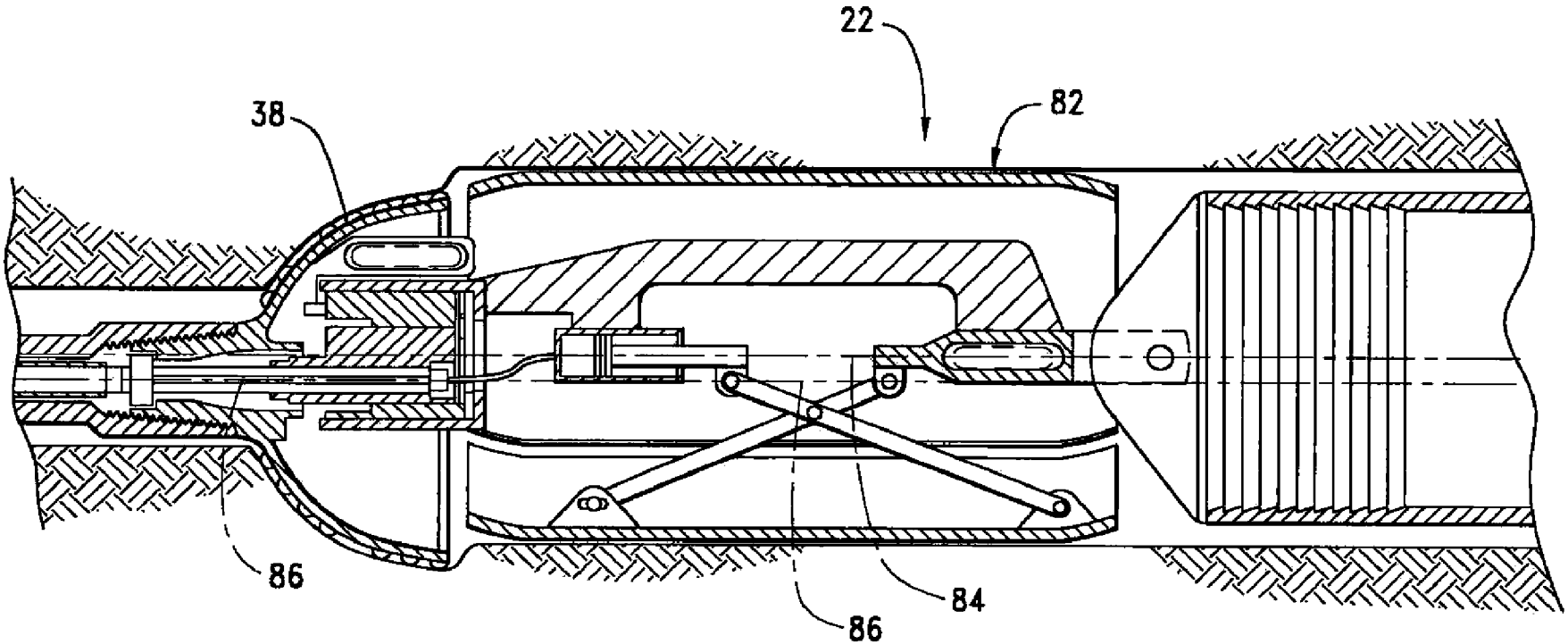
FIG. 5 is a partially sectional view of the guidable reamer assembly of FIG. 4 shown in a steering position.
Figure 5:
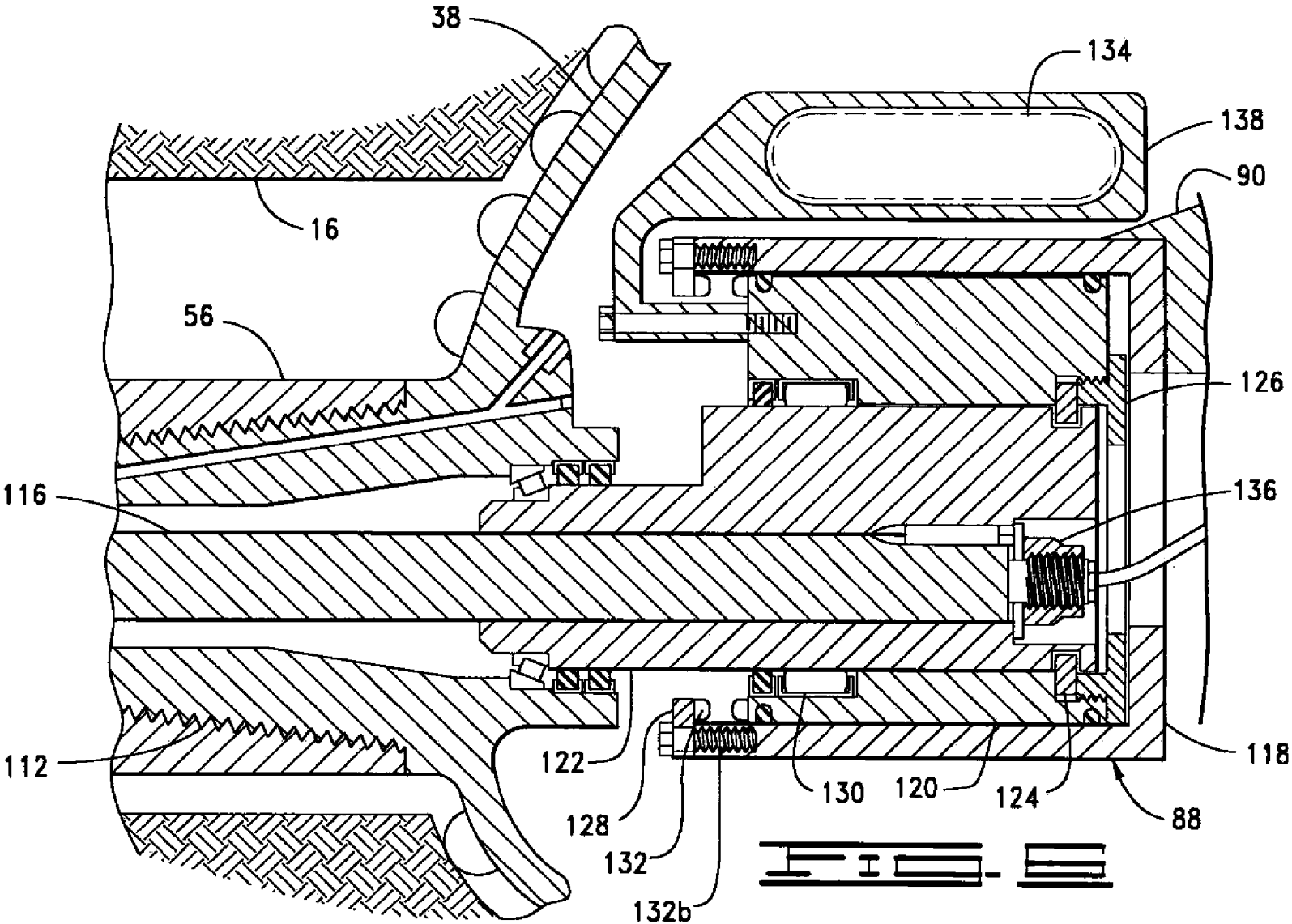

Counterclockwise rotation of the inner member drive group 78 (FIG. 3) may then position the outer eccentric cam 120 in the "steer down" position shown in FIGS. 5 and 6, or to any other desired rotational orientation. An appropriate sensor, such as steering assembly beacon 134 that is supported by outer eccentric cam 120 may be used to sense the roll orientation of the outer eccentric cam may be utilized to indicate that the desired steering direction has been achieved. The mating halves of jaw clutch 132 are engaged by pulling back on the carriage 28. Engagement of the jaw clutch 132 holds the outer eccentric cam 120 in a desired orientation with respect to housing 118. It should be noted that, for effective "steerability" of guidable reamer assembly 22, the orientation of outer eccentric cam 120 is desired to be absolute with respect to the Earth. Its relative orientation with respect to housing 118 is transformed to Earth reference by virtue of the previously described anti-rotation feature of support member 82.

Now that the desired steering direction has been set, deployment of the steering feature of guidable reamer assembly 22 is best described while referencing FIGS. 4, 5 and 6. To concur with these illustrations, the desired direction is the "steer down" orientation. Note that even though the direction setting has been made, cutting member 38 will still be in concentric axial alignment with support member 82 whenever a straight reaming segment of borehole 16 has just ended. Even when the last reaming segment was steered in another direction, preferably cutting member 38 is returned to concentric alignment before setting a new steering direction. This procedure minimizes over-cutting that might occur in the transition between adjacent, differentially-steered segments of borehole 42. Cutting member 38 may be deployed to the desired steering direction by clockwise rotation of inner shaft 116 under the control of inner member drive group 78. In this direction of rotation, inner eccentric cam 122 free-wheels within outer eccentric cam 120, as previously described. Full steering deployment is achieved when the two eccentricities are radially additive as shown in FIGS. 5 and 6. This relative rotational orientation—and other useful ones—between eccentric cams 120 and 122 may be set with the aid of a rotary encoder or sensor. The sensor output may be connected, for example, to beacon 134 and relayed as previously described to rotary drive system 18 for use in the control of inner member drive group 78. An uphole or downhole brake (not shown) may be applied to minimize incidental rotational drift, as well as prevent accidental operational indexing, of shaft 116.

Referring now to FIGS. 1, 4 and 6, outer member drive group 76 is activated to rotate cutting member 38 and guidable reamer assembly 22 commences to upsize the next segment of borehole 16 whenever pull-back is resumed by carriage 28 (FIG. 1). Progress may continue until need of further directional change in this set direction is no longer indicated by beacon assemblies 36 and 40 (FIG. 1) and monitoring system 44 previously described, or until need of a shift to a different steering direction is so indicated. The above deployment process may be applied in reverse to bring the cutting member 38 into concentric alignment, then re-deployed if so desired.

Returning to FIG. 6, inner eccentric cam 122 is keyed or otherwise rotationally engaged onto shaft 116, held axially thereon by threaded nut 136. Outer eccentric cam 120 surrounds inner eccentric cam 122, being axially restrained thereto. The signal transparent housing 138 containing beacon 134 is attached to outer eccentric cam 120, for purposes later described.

With reference again to FIG. 7, there is shown therein a cross-sectional view of the guidable reamer assembly 22 of FIG. 4 taken along line 7-7. FIG. 7 illustrates that steering assembly 88 is mounted in central axis alignment with the longitudinal axis 84 of support member 82. The housing 118 and retaining cover 128 of the steering assembly 88 surround outer eccentric cam 120, while allowing for an amount of axial movement. Thus the pullback and push (thrust) forces rotary drive system 18 applies may be transmitted downhole via outer drill string member 56 to pipe pulling link assembly 108, from where preferably only pullback force is exerted upon product pipe 14.

For illustrative purposes the support member 82 is shown in reduced diameter with respect to borehole 42 for the purpose of clarity in FIGS. 4-5 and 7. During most, if not all, operating modes of guidable reamer assembly 22, the support member 82 is deployed into frictional engagement with the wall of borehole 42. Alternate support barrel configurations are later described with respect to FIGS. 10-12.

Turning to FIG. 5, shown therein is the guidable reamer assembly 22 of FIG. 4 with its steering feature deployed. The central longitudinal axis 86 of cutting member 38 is shown laterally offset downwardly with respect to the central longitudinal axis 84 of the support member 82. As used herein, a "lateral" offset infers that the central drive axis of cutting member 38 remains substantially parallel to the central axis of support member 82 whenever the two axes are not colinear. Deployment of this offset may be toward any other desired radial direction through particular actions of the outer eccentric cam 120 and the inner eccentric cam 122 (FIG. 6), or by other suitable methods. For instance, the eccentrics 120 and 122 could be replaced by a rack and pinion arrangement supported within housing 118, where the pinion is rotated by inner member drive group 78. It will be appreciated that the inner eccentric cam 122 and the outer eccentric cam 120 may be further manipulated with respect to each other to adjust the lateral offset to be an amount between zero and a maximum. The maximum offset of deployed cutting member 38 is preferably not less than one inch, and may be greater than the radial clearance between drill pipe 20 and the wall of borehole 16.

Figure 8A:
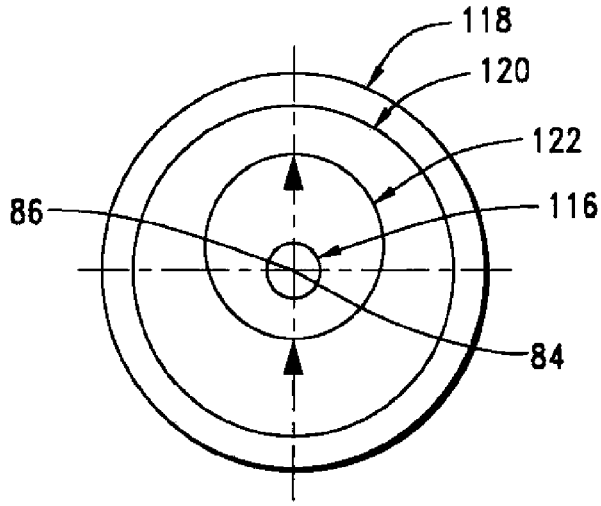
FIG. 8*a* is a diagrammatic cross-sectional view of the guidable reamer assembly taken along line 8-8 of FIG. 4.
Figure 8B:
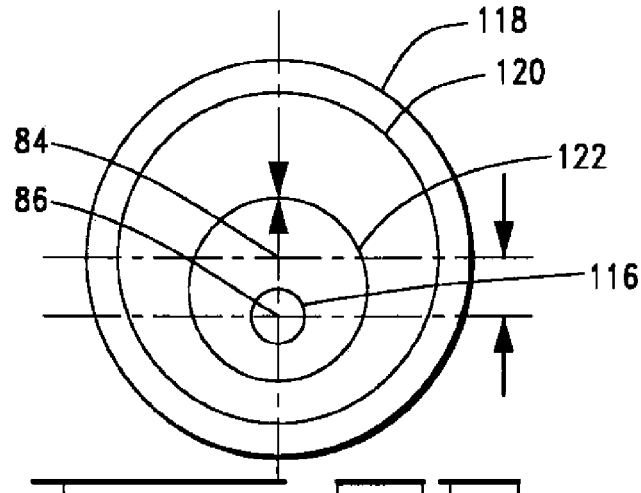
FIG. 8*b* is a diagrammatic cross-section view of the guidable reamer assembly of FIG. 4 showing the steering assembly in a steering position.
Figure 8C:
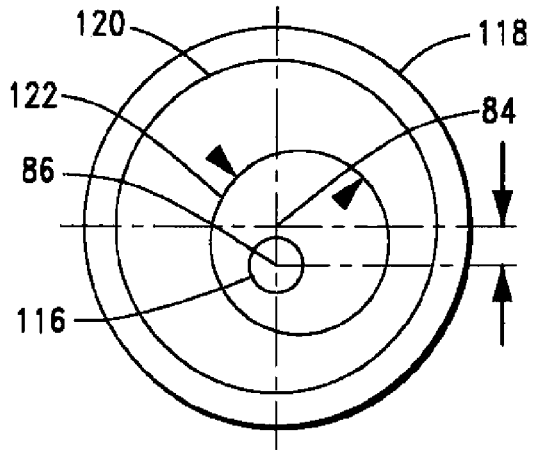
FIG. 8*c* is a diagrammatic cross-section view of the guidable reamer assembly of FIG. 4 showing the steering assembly in an alternative steering position.
Figure 3A:
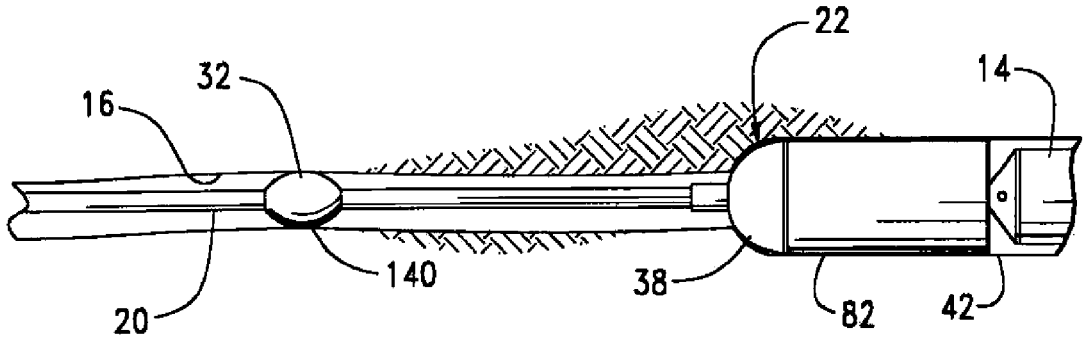
Figure 3B:
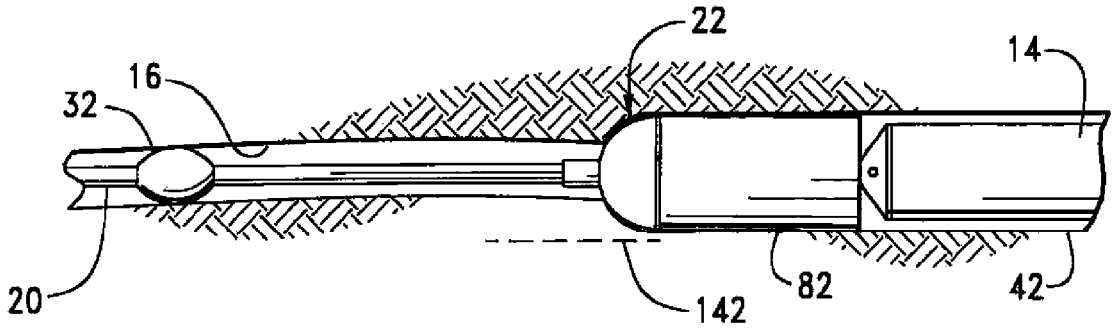
Figure 3C:
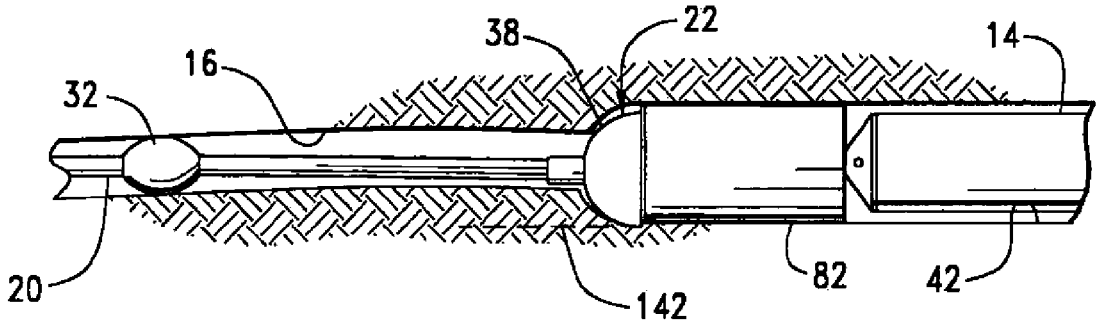
Figure 3D:
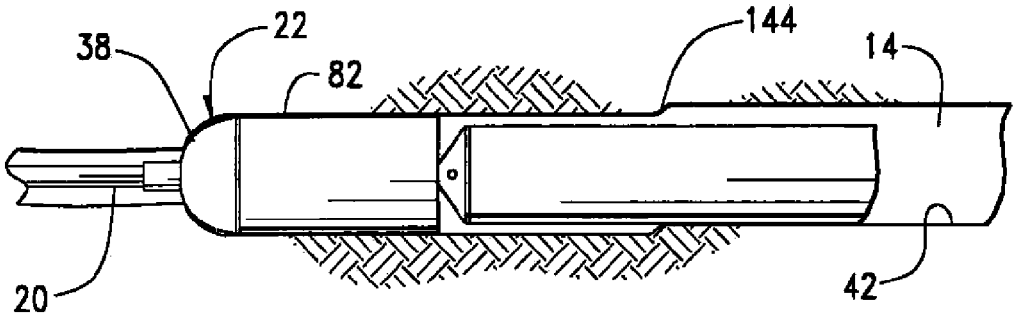

With reference now to FIGS. 8*a-c*, there is shown therein a diagrammatic representation of the steering assembly 88 of guidable reamer assembly 22 taken along line 8-8 of FIG. 4 showing the eccentric cams 120 and 122 in different relative positions to effect lateral displacement of the steering assembly central axis 86 relative to the central axis 84 of the support member. The central axis 86 of steering assembly 88 is utilized as the common frame of reference between views "a-c". To better illustrate the compound function of the inner eccentric cam 122 and outer eccentric cam 120, jaw clutch half 132*b* and one-way clutch 130 are not shown, nor is the fluid passageway through shaft 116. It should be noted that the eccentricity of outer eccentric cam 120 is on its internal surface, which mates with the eccentric external surface of inner eccentric cam 122. To aid the following discussion, the respective radius of maximum eccentricity for the inner eccentric cam 122 and outer eccentric cam 120 is indicated by a triangular symbol. Preferably, both components comprise the same amount of eccentricity. When that is the case, their relative rotational positions may be selected—as shown in FIG. 8*a*—such that their eccentricities negate each other, thereby positioning shaft 116 and cutting member 38 substantially concentric with housing 118 and support member 82. This selection is made whenever a course correction to borehole 16 is not required. It will be appreciated that the rotational position of this "neutral composite" of the inner and outer eccentric cams 122 and 120 in FIG. 8*a* has been so positioned only for ease of comparison to FIGS. 8*b* and 8*c*. So long as the inner and outer eccentric cams 122 and 120 maintain a neutral inter-relationship, outer eccentric cam 120 may be revolved within housing 118 without causing any offset between the shaft 116 and housing 118. FIG. 8*b* and 8*c* depict the steering orientation to be in the "steer down" or "6 o'clock" direction. FIG. 8*b* depicts the reorientation of the inner and outer eccentric cams 122 and 120 into their additive combination, yielding the greatest lateral offset of cutting member 38 with respect to support member 82. FIG. 8*c* illustrates approximate mirrored reorientations of the two eccentrics in comparison to the orientation of FIG. 8*b*. Appropriate relative positioning of this nature may be utilized to diminish the resultant additive vertical offset to an amount between zero and maximum, while maintaining a zero net offset horizontally.

The mechanics of orienting the inner and outer eccentric cams 122 and 120 into deployment, described above, also applies to the present focus on the eccentrics themselves. In the following discussions, the jaw clutch 132 is disengaged unless otherwise stated. Moving from zero to maximum composite offset in the steer down orientation—that is, moving from the orientation shown in FIG. 8*a* to the orientation shown in FIG. 8*b*—might be accomplished solely by rotating outer eccentric cam 120 one hundred and eighty (180) degrees if it were equipped with an independent rotational drive. For the present embodiment, achieving the orientation shown in FIG. 8*b* involves rotating outer eccentric cam 120 one hundred and eighty (180) degrees within housing 118, then rotating inner eccentric cam 122 one hundred and eighty (180) degrees with respect to the outer eccentric cam 120. Achieving the orientation of FIG. 8*b* is a multi-step process.

First, inner shaft 116 is rotated counter-clockwise (CCW), whereby outer eccentric cam 120 becomes locked, by one-way clutch 130 (FIG. 6), to inner eccentric cam 122. Next, pullback is applied to drill string 20 to engage jaw clutch 132. Inner shaft 116 is then rotated clockwise (CW) 180°—plus an amount equal to any lost motion in one-way clutch 130—to create the fill offset shown in FIG. 8*b*. Moving directly from the orientation of FIG. 8*a* to the orientation shown in FIG. 8*c*—an example having a composite offset approximately 70% of maximum in the steer down orientation—involves rotating outer eccentric cam 120 approximately 235° CCW within housing 118, then engaging jaw clutch 132 before inner eccentric cam 122 is rotated approximately the same angular amount oppositely with respect to the outer eccentric cam 120. Other proportional amounts of offset may be established in a similar manner. Deployment may be oriented toward other desired steering directions in the manner previously described. Even where need of a full deployment steering correction has been indicated, that deployment may be accomplished in incrementally increasing amounts separated by short periods of cutting member 38 rotation, perhaps interspersed with occasional short intervals of advance into borehole 16. This approach may be particularly useful in difficult soil conditions, such as rock.

Turning now to FIG. 9*a-d*, the use of guidable reamer assembly 22 to remove an undesired deviation in borehole 16 is illustrated at spaced intervals of time. FIG. 9*a* depicts guidable reamer assembly 22 as being "on course", but approaching an undesirable deviation 140 in the path of borehole 16. Advance indication of the deviation 140 may be given, for example, by beacon assembly 36 (FIG. 1) within centralizer 32. Another useful source of advance information is the historical positional database obtained over the length of borehole 16 while it was being drilled, or from a post-drilled survey. Advance knowledge of the impending need of corrective action allows the operator—or automated control system 48—to gradually deploy the steering feature of guidable reamer assembly 22 before its alignment can be substantially affected by the deviation 140. Once deployment begins, the associated unbalanced forces are reacted into the native soil surrounding support member 82. Engagement with the deviation 140 may cause higher reactionary forces that, in turn, result in localized compaction or displacement of the surrounding soil. The resulting reactionary forces may cause a shift in the alignment of the support member 82, as illustrated in second view of the series, FIG. 9*b*. To better visualize this shift, the desired alignment of borehole 42 is projected forward as the broken line 142 beneath support member 82.

In FIG. 9*c*, the cutting member 38 is shown moved to a larger offset to compensate for the "tilting" of the support member 82. Cutting member 38 is sufficiently laterally offset in FIG. 9*c* to resume cutting along the desired trajectory 142. As shown in FIG. 9*d*, the above-described reactionary forces and steering deployment create the beginning of a small ripple 144 in the alignment of borehole 42 at that location after the passage of the guidable reamer assembly 22.

Progressing beyond the third view, the cutting member 38 of guidable reamer assembly 22 will near the end of the necessary corrective action. The amount of offset can then be diminished, and the reactionary effect on support member 82 likewise diminishes. In FIG. 9*d*, the guidable reamer assembly 22 is about to enter an on-course segment of borehole 16. Cutting member 38 has been returned to concentric alignment with support member 82. The alignment ripple 144 in borehole 42 is generally insignificant enough that the placement of product pipe 14 is not effected.

It will be appreciated that the steering action described with reference to FIGS. 9*a-d* may be accomplished without the use of centralizer 32. In the absence of centralizer 32 and its associated beacon assembly 36, the actions of guidable reamer assembly 22 would remain much the same as depicted in FIGS. 9*a-d*. In that situation, the shift in support barrel alignment (FIG. 9*b*) could be detected by sensors within the reamer beacon assembly 40 (FIG. 1).

Figure 10:
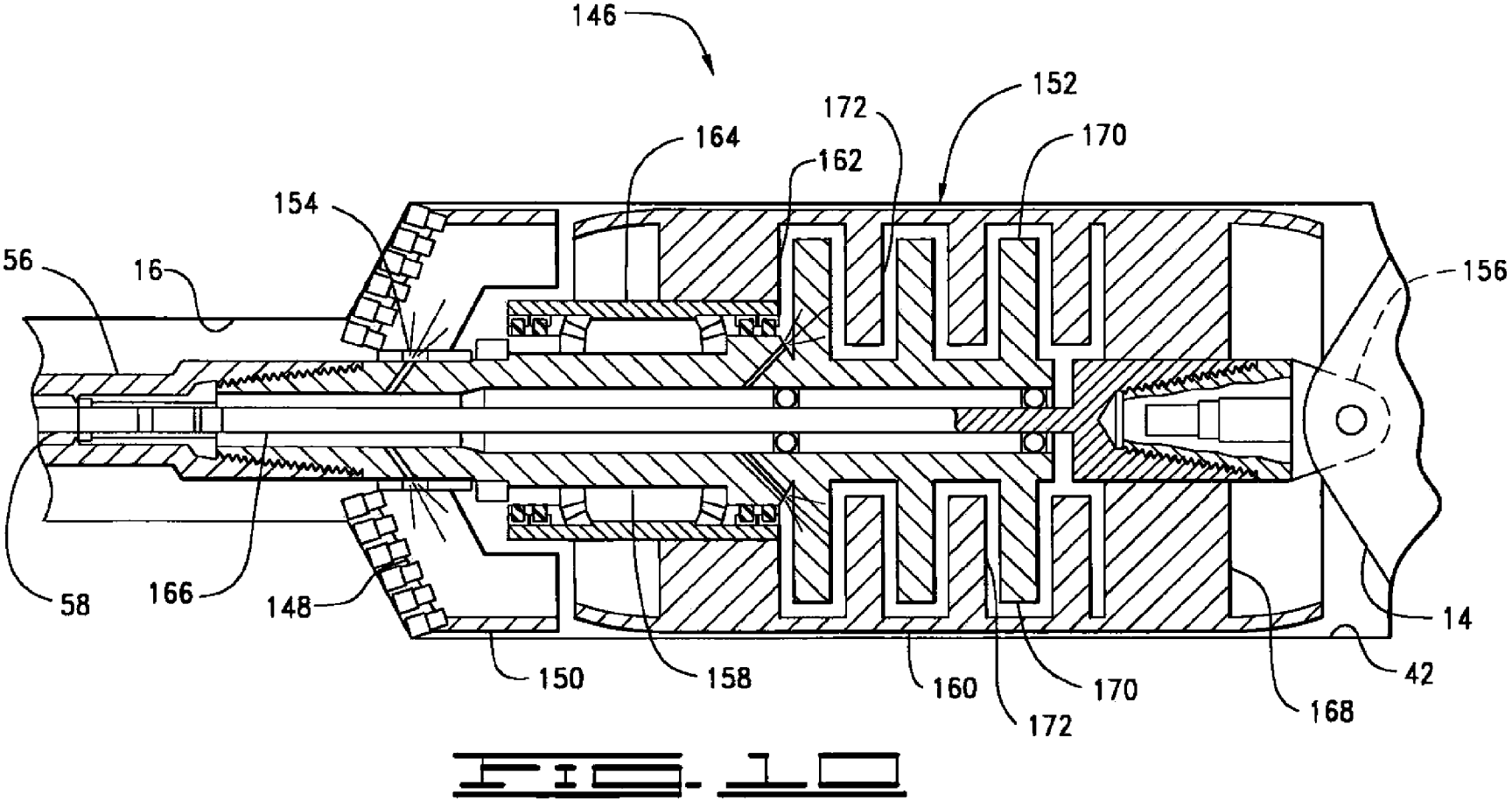
FIG. 10 is fragmented, a side elevational, sectional view of an alternative support barrel. The support barrel of FIG. 10 is adapted to mix reamer cuttings with drilling fluid.

Turning now to FIG. 10, shown therein is an alternative reamer assembly 146 used to enlarge borehole 16. Reamer assembly 146 comprises a cutting member 148, an outer ring 150, and a support member 152. The support member 152 of reamer assembly 146 is configured for mixing of reamer cuttings into the drilling fluid emitted from nozzles 154. Reamer assembly 146 further comprises a pipe pulling swivel 156 for the placement of product pipe 14. Cutting member 148 and the integrally attached outer ring 150 may be constructed similarly to one of several types of commonly known backreamers. Preferably, the cutting member 148 and outer ring 150 may be constructed to resemble a soil-cutting device of the "barrel reamer" or "water-wing reamer" type. The barrel reamer and water-wing reamer devices generally have carbide-tipped cutting teeth along the leading edges of the spokes (not readily seen in FIG. 10) and outer ring 150 of the reamer assembly 146. The outer ring 150 smoothes out the rotary action of the reamer assembly 146 by reacting unbalanced cutting forces into the borehole wall. Internal passages (not shown) within the spokes convey drilling fluid to the location at which soil cutting takes place.

Support member 152 comprises outer tubular member 160, a series of front support members 162 and a bearing housing 164. The support member 152 is bearingly supported on central support tube 158 in a push-pull resisting manner. The outer diameter of support member 152 closely approximates the cutting diameter of cuffing member 148. This close fit of the extended length support member 152 limits the tendency of cutting member 148 to drift off course downward under the influence of gravitational forces, or to undesirably rise above the desired path for borehole 42 from the influence of buoyancy of the product pipe 14 within the drill slurry (not shown) filling the annulus between the tubular member 160 and borehole 42.

Cutting member 148 and outer ring 150 are operatively connected to the outer member 56 of the drill string 20 (FIG. 1). The inner member 58 of the drill string 20 is operatively connected to an inner shaft 166 in the manner previously described with respect to FIG. 4. Inner shaft 166 extends through and beyond central support tube 158, while being bearingly supported therein. Inner shaft 166 is fixedly attached to the pipe pulling swivel 156 and, by way of a series of rear supporting members 168, to the outer tubular member 160 of support member 152. Support member 152 can thereby be preferentially held without rotation by proper control of inner member drive group 78 while outer member drive group 76 is engaged to rotate cutting member 148 during operation of reamer assembly 146.

Referring still to FIG. 10, a plurality of inner mixing bars 170 are fixedly mounted to the support tube 158. In cross-section the mixing bars 170 may comprise one or more of a variety of shapes, such as round, square, rectangular, or angular. The bars 170 extend radially away from the surface of support tube 158 in a distributed pattern. When rectangular and angular shapes are utilized for the bars 170, the orientation of those shapes may include varied angular alignments (not shown) of the plane of their width with respect to the central axis of support tube 158.

The interior of outer tubular member 160 may have a series of outer mixing bars 172 fixedly attached thereto. The outer mixing bars 172 extend radially inward toward central support tube 158 such that they substantially overlap the inner mixing bars 152 but do not touch the central support tube. The outer mixing bars 172 may also comprise one or more of a variety of shapes, such as round, square, rectangular, or angular. When rectangular and angular shapes are utilized for the outer mixing bars 172, the orientation of those shapes may have varied angular alignments of the plane of their width with respect to the central axis of support tube 158. The respective axial positions of the outer mixing bars 172 and the inner nixing bars 170 are staggered to prevent their contact during operation of the reamer assembly 146. As previously discussed, the preferred mode of operation is to hold inner member 58 of the drill string 20 stationary while rotating outer member 56. Rotation of outer member 56 causes the cutting member 148, outer ring 150, and inner mixing bars 170 to rotate. As the rotary drive system 18 withdraws drill string 20 from borehole 16, the rotating cutting member 148 and outer ring 150 will cause soil to be cut loose to form the enlarged borehole 42. The addition of drilling fluid to soil cuttings will begin to amalgamate the cuttings into a flowable slurry commonly referred to as "drill slurry". As the wetted cuttings pass through the outer tubular member 160, they are subjected to shearing between the rotating inner bars 170 and the stationary outer bars 172 furthering their mixing into slurry. Drilling fluid may also be injected at this mixing zone to improve the resulting flowability of the drill slurry for entrainment into the surrounding soil and displacement out the narrow annuluses around product pipe 14 and/or drill pipe 20. Drill slurry of this nature also provides improved lubrication for the drawing of product pipe 14 into borehole 42. Although the preferred mode of operation is the non-rotation of support member 152, it should be understood that slow rotation, or even counter-rotation, could be useful in achieving the desired level of mixing. It should also be apparent that the mixing features of reamer assembly 146 are adaptable to other reamer embodiments described herein.

Figure 11:
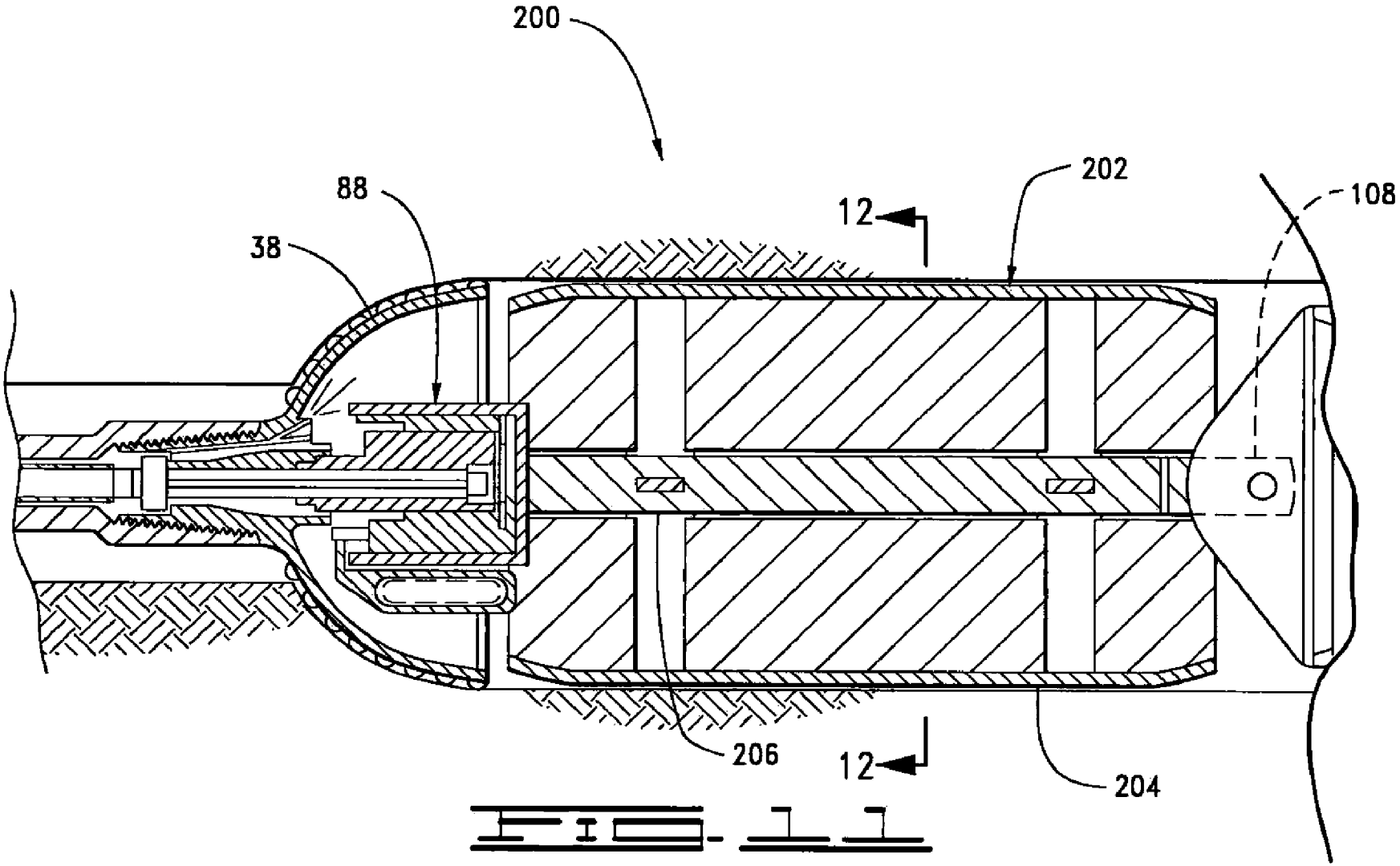
FIG. 11 is a fragmented, side elevational, sectional view of an alternative support barrel used with the guidable reamer assembly of FIGS. 4-6.

With reference now to FIG. 11, there is shown therein a side elevational, sectional view of an alternate guidable reamer assembly 200. The guidable reamer assembly 200 of FIG. 11 comprises cutting member 38 and steering assembly 88 and an alternative support member 202. The support member 202 comprises a plurality of borehole-engaging members 204 that may comprise ribs evenly spaced radially about a central shaft 206 of the support member. The central shaft 206 may be adapted for connection to the pipe pulling swivel 108.

Figure 12:
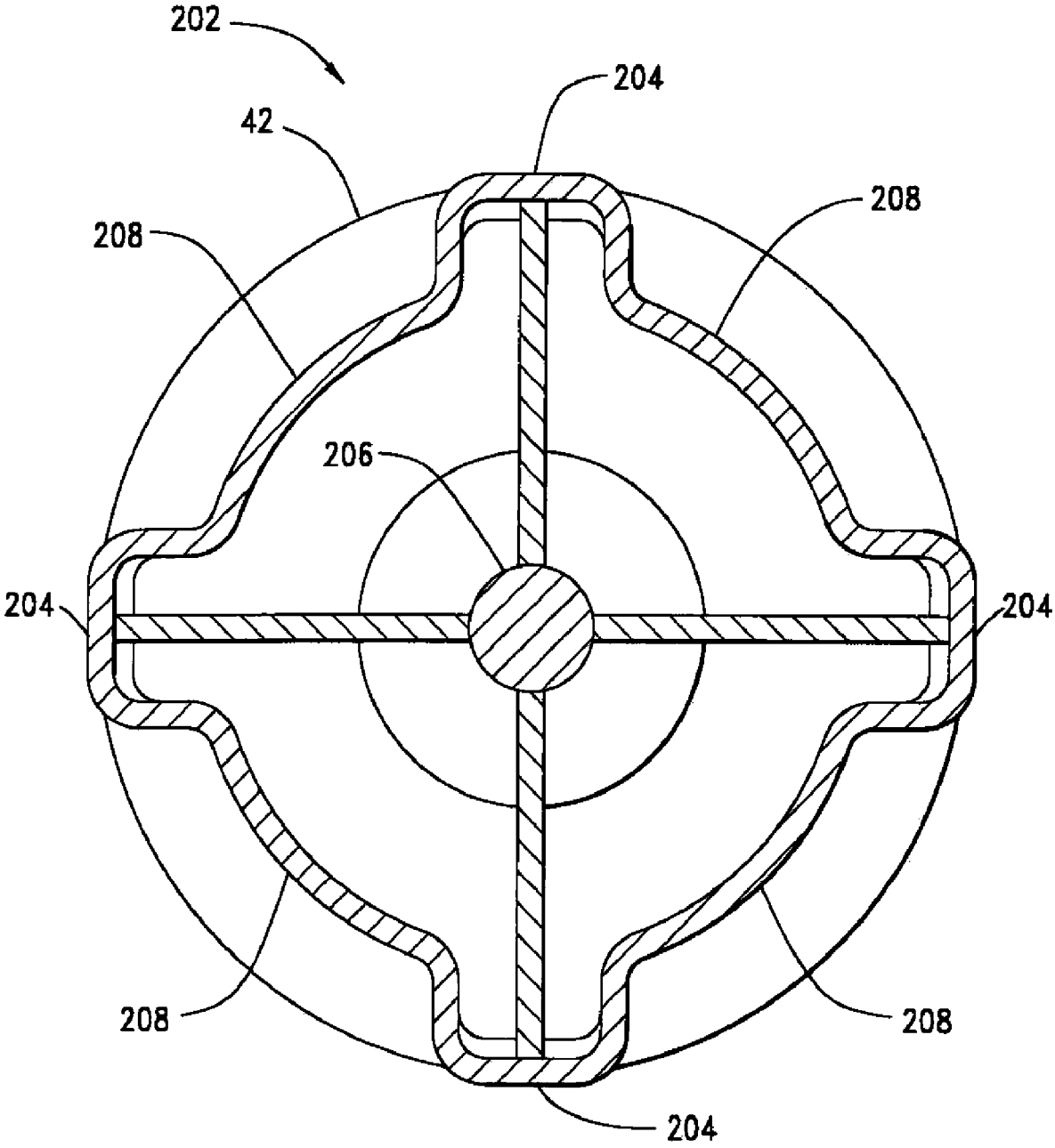
FIG. 12 is a cross-sectional view of the support barrel within a borehole taken along line 12-12 of FIG. 11.

Turning now to FIG. 12, the support member 202 of guidable reamer assembly 200 is shown in cross section along line 12-12 of FIG. 11. The cross section view of support member 202 illustrates areas of interference or borehole engaging ribs 204 intermittently around the circumference of support member. The borehole engaging ribs 204 limit rotation of support member 202 during short intervals of the support member's advance through borehole 42. This effect is desirable during steering actions of guidable reamer assembly 200. That is, once the direction of steering has been set, the support member 202 is held the desired orientation by the non-rotation and non-indexing of support member. To improve the utility of this support member 202 function over a wide range of soil conditions, the amount of interference the borehole engaging ribs 204 offer within borehole 42 may be varied, for example by the addition or removal of external shims (not shown).

The borehole engaging ribs 204 are separated by areas of relief or valleys 208 that provide annular passageways for the outflow of drill slurry. The valleys 208 may be sized such that their aggregate annular area is no less than the annular area between drill string 20 and borehole 42. It will be appreciated that a "scalloped" or concave construction may be utilized for the valleys 208 instead of the convex inner boundary depicted for them in FIG. 12.

Figure 13:
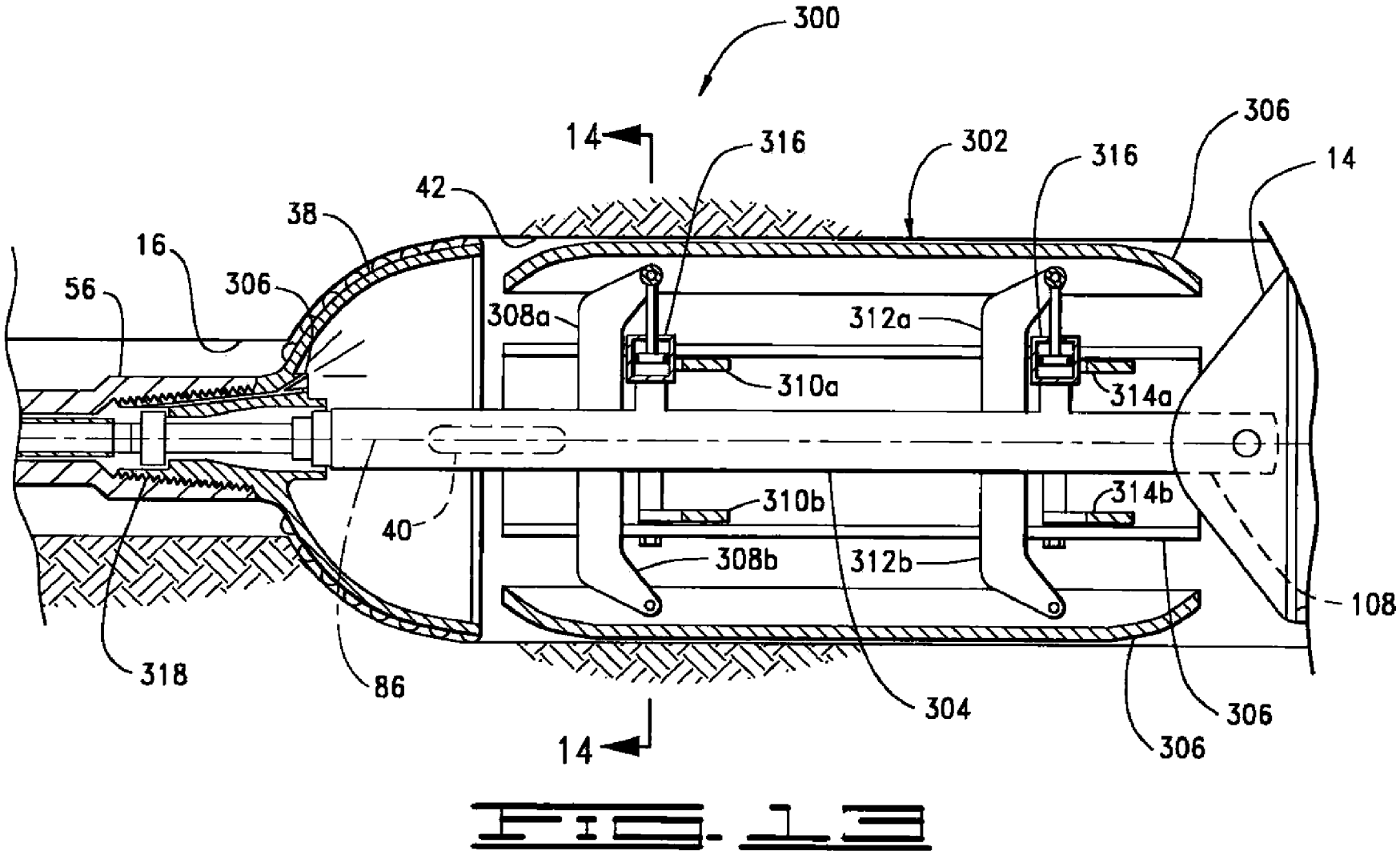
FIG. 13 is a fragmented, side elevational, sectional view of an alternative guidable reamer assembly. The guidable reamer assembly shown in FIG. 13 uses hydraulic pressure to guide the reamer.
Figure 14:
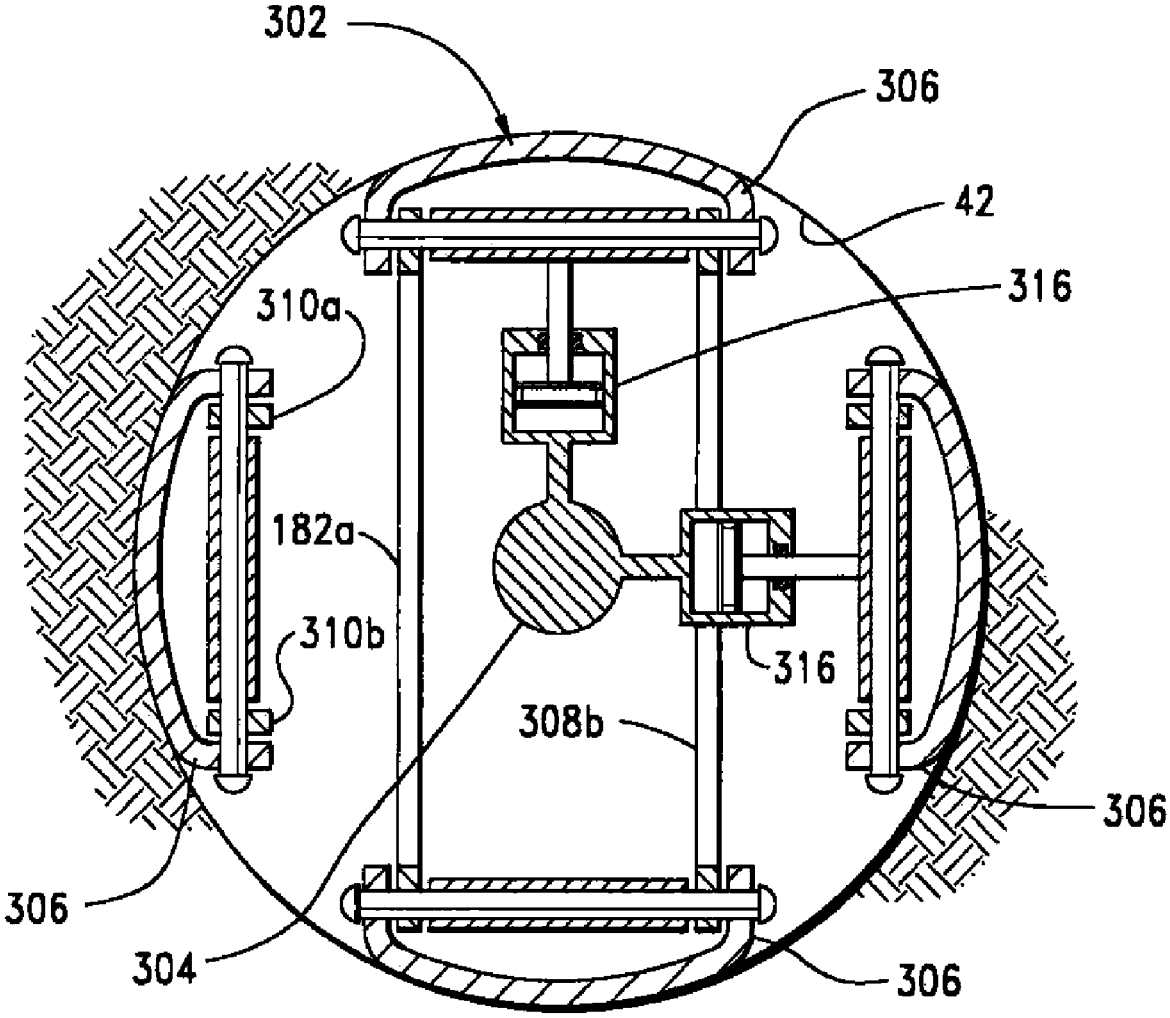
FIG. 14 is a cross-sectional view of the support barrel taken along line 14-14 of FIG. 13.
Figure 15:
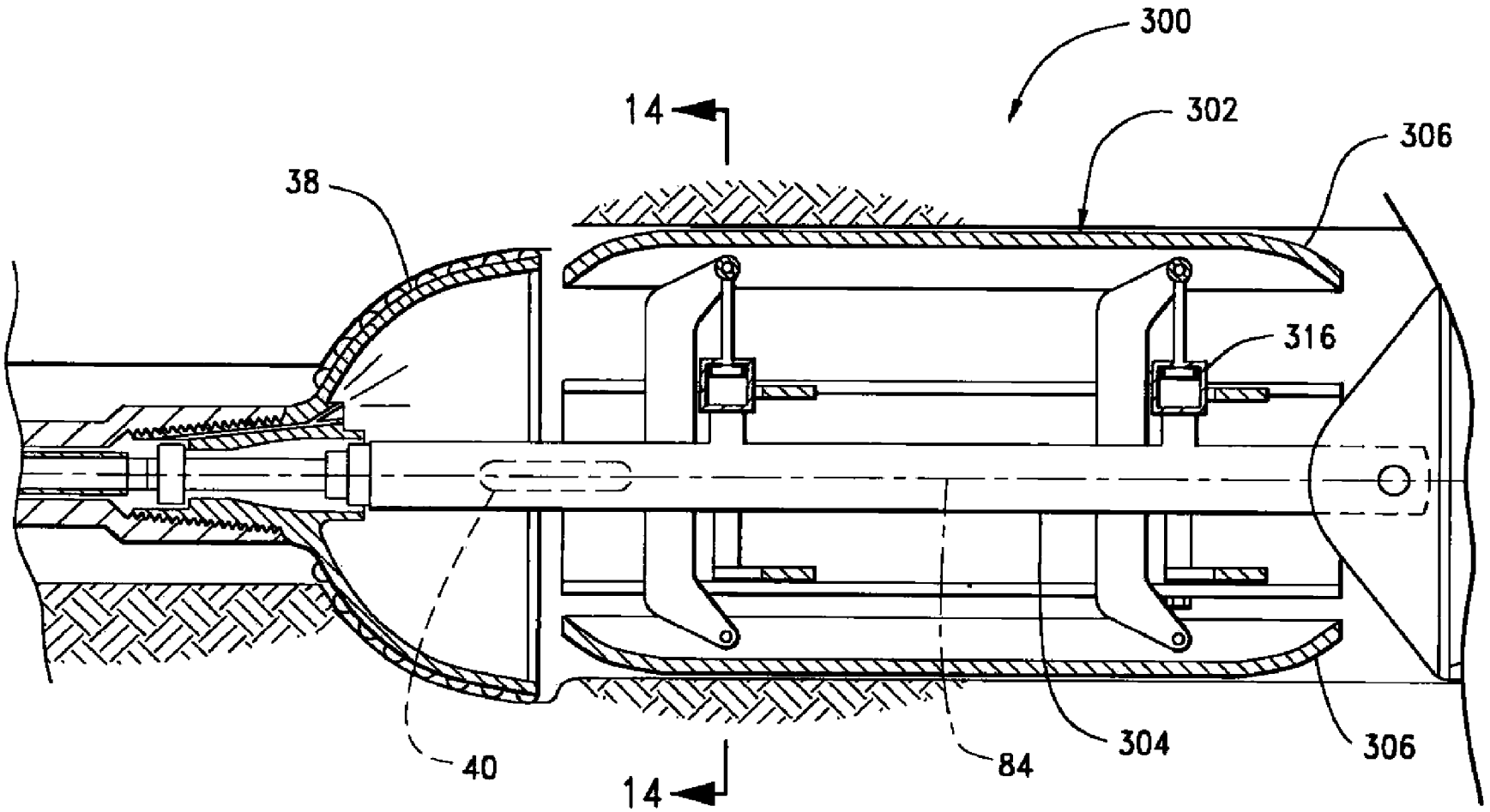
FIG. 15 is a sectional view of the guidable reamer assembly of FIG. 13, shown in a steering position.

With reference now to FIGS. 13-15, shown therein is an alternative embodiment of a guidable reamer assembly 300 used to enlarge a generally horizontal borehole 16. Guidable reamer assembly 300 is suitable to upsize borehole 16 in one or more passes for the installation of product pipe 14. Guidable reamer 300 comprises the cutting member 38 and support member 302. The support member 302 comprises a central shaft 304 and three or more borehole engaging members 306 that comprise steering wedges or ribs. The borehole engaging members 306 are preferably configured such that support member 302 has somewhat of a reduced diameter at its leading and trailing ends to ease its movement through the enlarged borehole 42 created by cutting member 38.

The central shaft 304 may terminate into a pipe pulling link 108 for connection to the product pipe 14. Central shaft 304 may further comprise provisions (not illustrated)—such as a commonly known side-entry housing and slotted cover plate—for housing the reamer beacon assembly 40 capable of at least roll and pitch sensing, useful for purposes previously described. One or more nozzles 306 dispense sufficient drilling fluid to suitably slurry (liquefy) the soil cuttings, easing their flow through the guidable reamer assembly 300 and their displacement from the borehole 16 to accommodate product pipe 14.

Preferably, the support member 302 is substantially the same diameter as, or a slight interference fit in, the enlarged borehole 42. To improve the yet to be described functions of support member 302 over a wide range of soil conditions, its diametrical fit within borehole 42 may be varied, for example, by the addition or removal of external shims (not shown) on the borehole engaging surfaces of the steering wedges. The borehole engaging members 306 form a discontinuous cylindrical-like, longitudinally-ribbed outer surface for support member 302. Preferably, the borehole engaging members 306 are arranged in diametrically opposed pairs substantially equally distributed around the circumference of support member 302. However, an odd number of borehole engaging members 306 could be used without departing from the scope of the invention. Their width may be sized or adjusted, if necessary, to provide (in combination with their length) an appropriate amount of borehole contact. This contact area is made sufficiently large to resist the normal tendency of cutting member 38 to drift off course downward under the influence of gravitational forces, or to undesirably rise above the desired path for borehole 42 from the influence of buoyancy of the product pipe 14 within the drill slurry filling the annulus between it and borehole 42. For average soil conditions, the combined width of borehole engaging members 306 may occupy approximately 60 to 75% of the circumference of support member 302.

The diametrically opposed pairs of borehole engaging members 306 may be interconnected by front (308*a-b* & 310*a-b*) and rear (312*a-b* & 314*a-b*) pairs of connecting links, wherein the mates of each pair straddle central shaft 304 with a purposeful amount of radial clearance. The borehole engaging members 306 may be anchored to central shaft 304 by respective pairs of linear actuators 316, supplemented by other appropriate axial load resisting provisions (not shown) that—for the useful steering purpose yet to be described—allow transverse relative motion between the paired borehole engaging wedges and the central shaft. For instance, contact surfaces (not shown) affixed perpendicularly to central shaft 304 fore and aft of each pair of connecting links 308 and 314 could provide this supplemental load-resisting function. By way of the connecting links 308 and 314 and appropriate extensional position sensors (not shown) for linear actuators 316, the central axis of central shaft 304 may be held in approximate concentric alignment with support member 302 or, when desirable, moved in one of many possible radial directions to positions laterally offset with respect thereto—any of which may be accomplished under manual or automated control, as previously indicated. To ensure the control of linear actuators 316 creates the desired direction of offset, a sensor such as the roll-sensing reamer beacon assembly 40 may be utilized to give indication of the rotational orientation being held for support member 302. To cause a lateral offset, the linear actuators 316 for a particular pair of borehole engaging members 306 are extended (or retracted) substantially the same amount. This may be accomplished by suitable hydraulic circuitry (not shown) or other known techniques. Similar to the guidable reamer assembly 22 of FIG. 4, power may be supplied to the actuators 316 by one of a variety of well-known techniques—for instance, by remote power routed through the product pipe 14 or supplied by way of drill string 20 or by an on-board power system. Of course, it will be appreciated that the linear actuators 316 other than hydraulic cylinders may also be utilized.

It will be appreciated that paired linear actuators 316 may be utilized on each borehole engaging member 306, thereby negating the need of connecting links 308*a-b*, 310*a-b*, 312*a-b* and 314*a-b*. This allows individual control of the borehole engaging members 306, which may be advantageous applied to adjust the "tightness of fit" the support member 302 has within borehole 42 at any time during the backreaming process. Thus, widely varying soil conditions may be much more readily accommodated than possible with the previously mentioned external shims (not shown). The fit of support member 302 may be controlled by monitoring and adjusting, for instance, the force of the linear actuators 316 or the hydraulic pressure within them. The ability to independently vary diametrical fit in two perpendicular directions is now possible as well. This may be advantageously applied to ease the passage of support member 302 across transitions into and out of a correctively steered segment of borehole 42—e.g., deviation 140 (FIG. 9).

FIGS. 13 and 14 illustrate guidable reamer assembly 300 in its neutral, undeployed state; i.e., the central axes 84 and 86 of cutting member 86 and support member 302 are in collinear alignment with each other Guidable reamer assembly 300 is attached to the downhole end of outer member 56 of drill string 20 by way of threaded connection 318 or other commonly known push-pull and torque-transmitting attachment means. Thus, the rotation of cutting member 38 is accomplished with and controlled by outer member drive group 76. Tapered roller bearings (not shown), or other push-pull resisting bearing arrangements, prevent axial displacement of central shaft 304 with respect to the pin portion of threaded connection 318—thereby holding the cutting member 38 and support member 302 in assembly.

The inner member 58 of drill string 20 connects to central shaft 304 in the manner previously described with respect to FIG. 4. During operation of guidable reamer assembly 300, support member 302 can be held without rotation by proper control of inner member drive group 78 whenever outer member drive group 76 is engaged to rotate cutting member 38. An uphole or downhole brake (not shown) may be applied to minimize incidental rotational drift, as well as prevent accidental operational indexing, of central shaft 304. In the absence of such a brake, rotational drift of support member 302 could be overcome by readjusting the steering deployment to the correct direction utilizing the roll sensor output of reamer beacon assembly 40 as feedback.

Turning now to FIG. 15, there is shown therein the guidable reamer assembly 300 of FIG. 13 with its steering feature deployed. Cutting member 38 and central shaft 304 are shown laterally offset downwardly with respect to the central axis 84 of support member 302. "Lateral" offset infers that the central axis 86 of cutting member 38 remains substantially parallel to the central axis 84 of support member 302 whenever the two axes are not collinear. Deployment may be toward any other desired radial direction through particular actions of one or more pairs of the linear actuators 316, or by other suitable methods. The deployment process may be applied in reverse to bring the cutting member 38 back into collinear alignment with support member 302, to be re-deployed when the need again is so indicated. The amount of offset may be set between zero and maximum, as desired, where the maximum offset of deployed cutting member 38 is preferably greater than the radial clearance between drill string 20 and the wall of borehole 16.

From an external viewpoint, description of the operation and control of guidable reamer assembly 300 closely follow that for the guidable reamer assembly 22 of FIGS. 4-5 and 9. The primary external difference is that inner drive group 78 is used to hold support member 302 without rotation, whereas the support member 82 (FIG. 4) of guidable reamer assembly 22 is held substantially without rotation by the friction or texture of its external surface.

Outer member drive group 76 is activated to rotate cutting member 38 and guidable reamer assembly 300 commences to upsize borehole 16 whenever pull-back is initiated by rotary drive system 18. Progress continues until the need for corrective steering is indicated by, for example, the position and orientation monitoring reamer beacon assembly 40 and monitoring system 44 (FIG. 1). Cutting member 38 is laterally deployed an appropriate amount in the desired radial direction and pullback continues until the corrective action has been completed, or need of a shift to a different steering direction is so indicated. To execute certain steering corrections—such as those on up or down left-right 45° diagonal directions—it may be desirable to reorient one set of paired borehole engaging members 306 to the desired diagonal. Support member 302 can be rotationally indexed to desired orientations by inner drive group 78. The description with respect to FIG. 9 may be referred to for further operational understanding of guidable reamer assembly 300.

Figure 16:
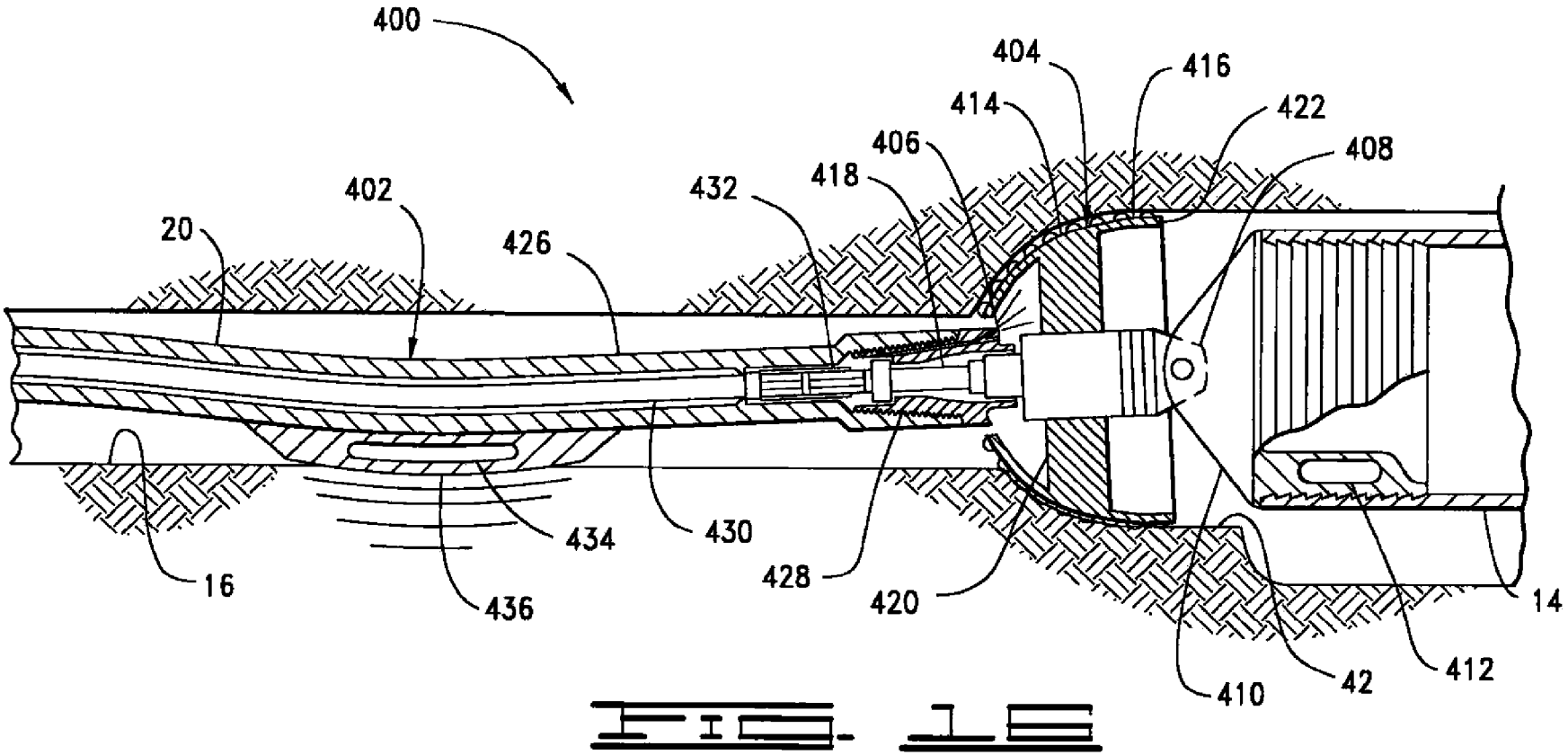
FIG. 16 is a side elevational, partly sectional view of an alternative of the guidable reamer assembly. The assembly of FIG. 16 has a bent housing that may be orientated using the drill string.

With reference now to FIG. 16, shown therein is another alternative embodiment of the guidable reamer assembly of the present invention. The guidable reamer assembly 400 of FIG. 16 is suitable for enlarging borehole 16 in one or more passes for the installation of product pipe 14 in the finally upsized borehole 42. For illustrative purposes, guidable reamer assembly 400 is shown to have entered into a yet to be described steering mode. Similarly to other guidable reamer assemblies described herein, the guidable reamer assembly 400 is useful for counteracting transverse forces exerted by factors such as gravity, soil stratifications and rocks or similar obstacles encountered non-symmetrically across the diameter of borehole 42. In applications such as the on-grade placement of product pipe 14, guidable reamer assembly 400 is particularly suited for correcting deviations 140 (FIGS. 9*a-d*) in borehole 16.

Guidable reamer assembly 400 comprises a support member 402 that may be a "bent" transition segment connectable to the dual-member drill string 20 of HDD system 10 (FIGS. 1-2), a cutting member 404, and one or more drilling fluid dispensing nozzles 406. The nozzles 406 dispense sufficient drilling fluid to slurry the soil cuttings, easing their flow through the guidable reamer assembly 400 and their displacement from the boreholes 16 and/or 42 to accommodate product pipe 14. (Where used to identify the cutting elements of guidable reamer assembly 400, the term "cutting member" is not intended to imply the absence of openings or channels for direct passage of soil cuttings.) Reamer assembly 400 may further comprise a pipe pulling swivel 408 for connection to a pipe pulling cap 410 mounted in the leading end of product pipe 14. The guidable reamer assembly 400 may also comprise at least one centralizer 32 (FIG. 1) assembled into the drill string 20, or onto outer drill string member 56. When one or more centralizers 32 are utilized, the nearest may be advantageously positioned near to or between the interface of bent segment 402 to drill string 20—a point generally less than 20 feet forward of the cutting member 404. The centralizer(s) 32 may be useful to augment drill string 20 reactionary support of the yet to be described bent segment 402. One centralizer 32 may be adapted to contain an electronic transmitter such as beacon assembly 36, useful for purposes previously described. A beacon (not shown) placed within cutting member 404 and/or a beacon 412 signal-emissively housed within the leading end of product pipe 14—either beacon capable of sensing at least one of the orientations of pitch and yaw—may further augment the control of guidable reamer 400 for proper placement of product pipe 14 along a desired path.

Cutting member 404 may comprise a frontal cutting surface segment 414, a cutting ring 416, a central drive shaft 418, and intermediate supporting structure 420. Cutting ring 416, though appearing cylindrical-like, tapers to a narrowed diameter at its trailing end 422. For reasons later described, cutting ring 416 preferably approximates a segment of a hemisphere—wherein the largest diameter end 424 of the segment is sized to transition into the cutting member 404. Its largest end 424 may be of diameter equal to or smaller than the diameter of the hemisphere from which the segment is extracted. The cutting member 404 is axially connectable to the downhole end of the outer member 56 (FIG. 2) of drill string 20, for instance by way of the outer housing 426 of bent segment 402, threaded connection 428 (or other commonly known push-pull attachment means), and the push-pull resisting bearing support of its central drive shaft 418. The bearing support of central drive shaft 418 rotationally uncouples cutting member 404 from the outer member 56 of drill string 20. Central drive shaft 418 is rotationally—though not necessarily axially—coupled to the inner member 58 (FIG. 2) of the drill string 20, for instance by way of the flexible member 430 of bent segment 402 and slip-fit geometric coupling 432. Thus, the rotation of cutting member 404 is accomplished with and controlled by inner member drive group 78 (FIG. 3). The outer drill string member 56, being uncoupled rotationally from cutting member 404, may be held without rotation or, as sometimes desired, slowly rotated by proper control of outer member drive group 76. As will be more fully explained, slow rotation of outer drill string member 56 during its pull-back "advance" of guidable reamer assembly 400 creates an upsized borehole segment 42 substantially aligned with borehole 16, while its non-rotation creates a changed alignment or a curved segment in borehole 42. For illustrative purposes only, FIG. 16 depicts the guidable reamer 400 as having recently transitioned from the first operating mode to the second, the latter being oriented for a "steer up" correction.

With continued reference to FIG. 16 and as previously discussed, the bent segment 402 comprises a "bent" outer housing 426 (sometimes referred to as a "bent sub" or "bent housing") and a flexible inner member 430. Their assembly may be constructed in much the same manner as illustrated in FIG. 2. The outer housing 426 may have provisions (not illustrated) for the signal-emissive housing of the beacon 434 in fixed rotational relationship to its bend. The roll-orientation sensor equipped beacon 434 and monitoring system 44 (FIG. 1) may then be utilized to determine—or index with outer member drive group 76—the rotational location of the bend in segment 402. One or both ends of flexible inner member 430 may additionally be bearingly supported (not illustrated) within housing 426. The uphole ends of the member 430 and housing 426 are suitably configured for connection to the respective downhole ends of the outer 56 and inner 58 members of drill string 20. The shape or centerline profile of the bent outer housing 426 may approximate a circumferential segment of a circle 100 inches or more in diameter. Alternately, it may be constructed of several (2-3 or more) fixedly-joined straight tubular segments. The proper end-to-end axial bend in housing 426, typically falling within the range of 0° to 15°, depends in part on the diameter of borehole 16. By the purposeful selection of the outer diameter and/or external shape of housing 426, its bend more preferably falls within the range of 2° to 8°. The axial interconnection of bent housing 426 to cutting member 404 may result in the tilting of the central axis of the cutting surface with respect to the central axis of borehole 16. This tilting, though not necessarily constant for reasons that will soon become clear, is an angle approximately one-half that of the end-to-end bend in the housing 426. By purposeful selection of its bend angle and other design parameters, the "elbow" of bent housing 426 bears against the wall of borehole 16 with sufficient interference to continually create an axially advancing and sometimes revolving fulcrum point 436. At a distance uphole of fulcrum 436, the drill string 20—being connected collinearly to the uphole end of bent housing 426—must be deflected to fit within substantially straight borehole 16. This provides leverage about the fulcrum 436 to apply a lateral bias to the cutting member 404 directed diametrically opposite of the fulcrum. The addition of centralizer(s) 32 to drill string 20 somewhat changes the character of the guidable reamer assembly's 400 deflection within borehole 16. Larger diameter boreholes 16 accentuate this change. Therefore, to ensure the proper amount of leverage is applied to the cutting member 404, the design of the bend in housing 426 may need to be specific in relation to whether or not a centralizer 32 is used in the drill string 20.

When borehole 42 is known to be progressing along the desired straight path, the first of the two above-mentioned operating modes for guidable reamer assembly 400 is utilized; i.e., slow rotation of outer member 56 of drill string 20. In this case, the leverage off fulcrum 436 created within borehole 16 translates into a continually rotating side force on cutting member 404—most particularly on its cutting ring 416. The combination of previously-described axial tilt and purposeful curved shape of cutting ring 416 orients the ring more nearly into tangential engagement with the wall of the upsized borehole 42 in the area where this side force is brought to bear—i.e., side-opposite of fulcrum point 436. The purposeful shortfall in achieving tangency provides advantageous relief at the trailing end of cutting ring 416 in the event push-back of the cutting member 404 from soil engagement is found necessary. The portion of cutting ring 416 diametrically opposite of the applied side force may deliver little or no cutting action toward the forming of borehole 42. Depending upon the nature of soil conditions in relation to parameters such as the advance and rotation rates of the cutting member 404, the aggressiveness of cutters on ring 416 in comparison to cutters on frontal cutting surface 414, and the magnitude of the leverage-created side load, a gap may develop between the wall of borehole 42 and this diametrically side-force-opposite interval of ring 416. Whenever this occurs, the borehole 42 is reamed to a diameter somewhat larger than cutting member 404. (Reference the right hand portion of borehole 42 in FIG. 16, which illustrates the resulting diameter in purposeful exaggeration.) In the presence of this gap, excessive rotational speeds may cause the cutting action to become somewhat unstable, creating a whirling motion inside borehole 42 and potentially creating it as a non-circular hole. To reduce the likelihood of this happenstance, the rotational speed of the cutting member 404 may be lowered in relation to the output speed of inner member drive group 78 by inclusion of torque-multiplying gearing a some point within their interconnecting drive arrangement. Most preferably, the point of inclusion would be between central drive shaft 418 and cutting member 404.

In the present operating mode, the rotational speed of the outer member 56 of the drill string 20 is preferably held substantially below that of cutting member 404. The outer member may be rotated at less than 20 rpm in "average" soils. (On the order of 10-20 revolutions per foot of advance is sufficient to create a straight segment of borehole 42.) The low and zero rotational modes of the outer member 56 of the drill string 20 advantageously reduces its wearing action along the wall of borehole 16, thereby limiting potentially undesirable shifts in its alignment.

The second operating mode (i.e., non-rotation of the outer member 56 of the drill string 20) is useful for directing borehole 42 back onto its desired alignment and for maintaining a given alignment in the face of such effects as the previously-described transverse forces and undesired inconsistencies in the alignment of borehole 16. When the outer member 56 of the drill string 20 is held without rotation, the fulcrum point 436 "elbow" of bent housing 426 slides along the wall of borehole 16 while the guidable reamer assembly 400 advances. This sliding fulcrum point 436 may be positioned at a desired radial orientation by way of the roll sensing beacon 434 and held in that direction with the aid of a brake (not shown) on outer member drive group 76. The leverage created off the fulcrum within borehole 16 will tend to cause the centerline of upsized borehole 42 to no longer be coincidental with that of borehole 16 moving it in the direction diametrically opposite the orientation of fulcrum point 436. The diameter formed for borehole 42 may also be reduced in comparison to that formed in the previously described operating mode. (Compare the exaggerated diametrical difference between the left and right hand portions of upsized borehole 42 in FIG. 16.) The leverage of bent housing 426 may be enhanced by increasing the amount of interference its elbow has within borehole 16. This may be accomplished by attaching an external shim (not shown) at the fulcrum point 436 or by utilizing a larger diameter and/or more highly angled bent housing 426. Conversely, the re-directive steering effect of the leverage may be diminished by reducing the built-in leverage or, for a given leverage set-up, by interjecting short intervals of housing 426 rotation within the periods where it is advanced without rotation.

If the bent housing 426 of guidable reamer assembly 400 is constructed with a zero-degree bend angle, the now straight central axis of housing 426 removes the tilted-orientation of cutting member 404. Leverage-induced side load on the cutting member 404 is maintained by enlarging the eccentric external shape of the housing 426 at the location of beacon 434, such that the borehole interference caused fulcrum point 436 is maintained as before. In other words, the radius of the housing 426 at the point of maximum eccentricity is larger than one-half the diameter of borehole 16. Other descriptions and the two operating modes of FIG. 16 apply here.

Figure 17:
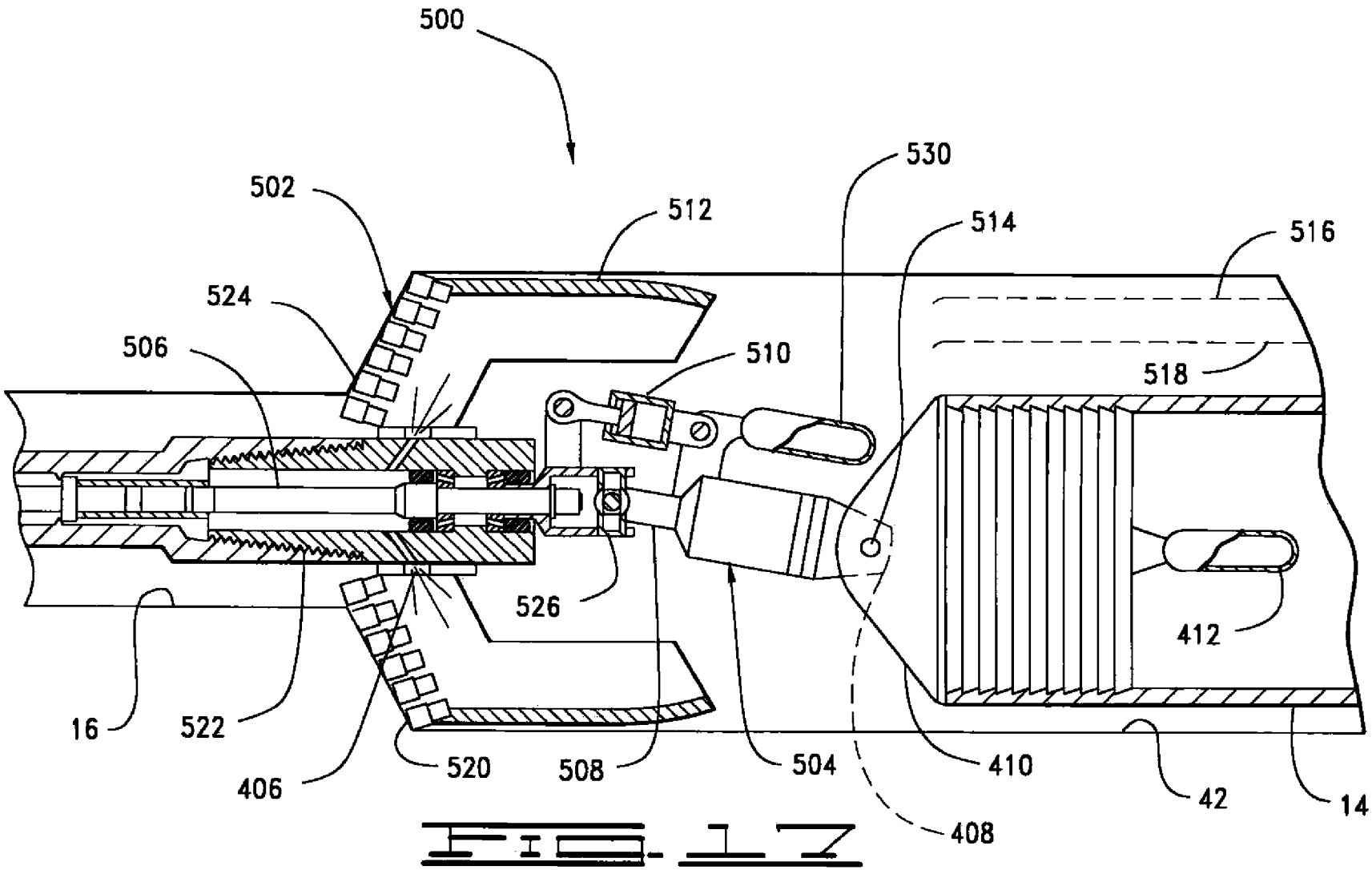
FIG. 17 is a side elevational, partly sectional view of another alternative embodiment of the guidable reamer assembly. The assembly of FIG. 17 is adapted to position the product pipe within the borehole behind the reamer.
Figure 7E:
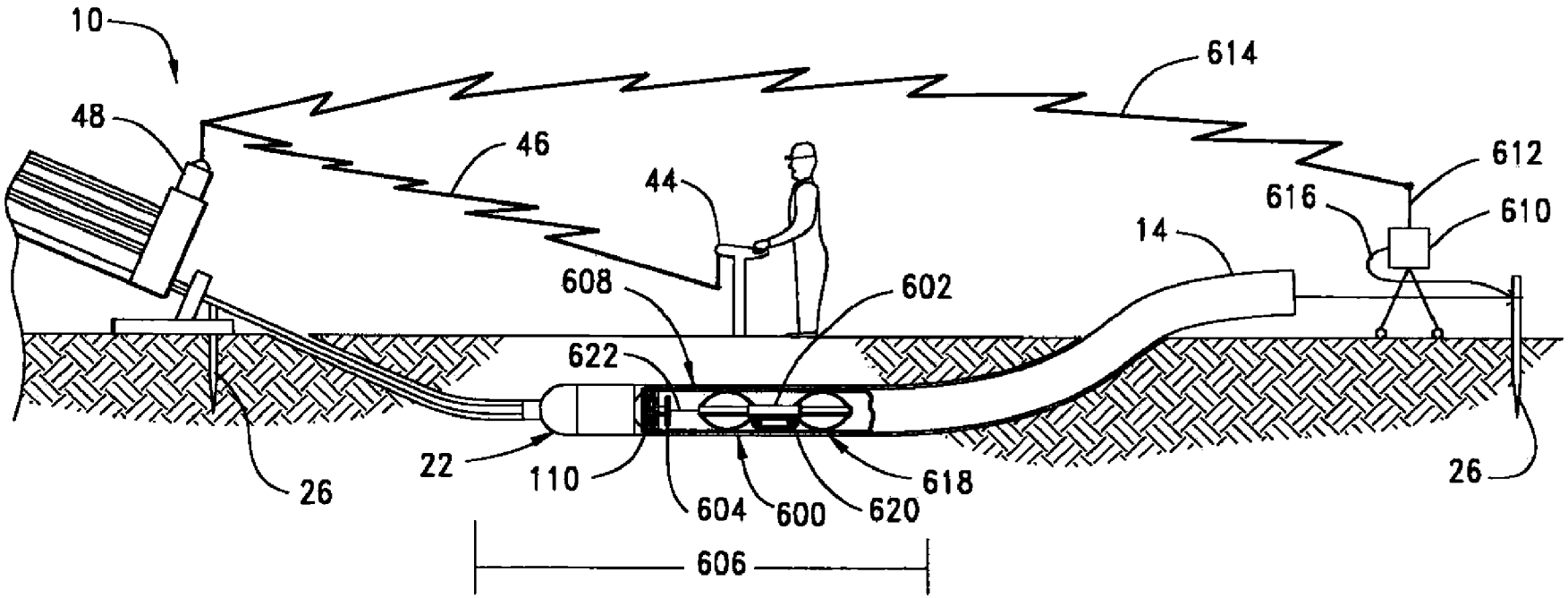

Turning now to FIG. 17, shown therein is a product pipe positioning reamer assembly 500 suitable for attachment to the dual-member drill string 20 of HDD system 10. Although not required, the borehole-enlarging reamer assembly may itself be guidable in a manner described elsewhere herein. The reamer assembly 500 comprises a borehole enlarging and engaging surface 502 with one or more fluid dispensing nozzles 406 and a product pipe positioning assembly 504 useful for the purposeful radial placement of product pipe 14 within the finally upsized borehole 42. Because of this radial pipe-positioning feature, reamer assembly 500 is particularly useful for critical applications such as the on-grade placement of product pipe 14. The pipe positioning assembly 504 allows final adjustments to be made in the on-grade and/or on-line placement of product pipe 14 by the selective radial positioning of the line of pull applied to product pipe as it is drawn into a borehole 42 that may not have been precisely created in accordance with the desired installation alignment. The amount of offset and its radial orientation selected for positioning of the product pipe 14 may be varied, whenever required, while the reamer assembly 500 advances along borehole 16 to enlarge it. The need of making such adjustments may be determined and controlled with the aid of, for example, the previously described pitch-sensing beacon 412 signal-emissively housed within the product pipe 14 or a yet to be described in-pipe alignment-sensing system. To increase the utility of this process, the borehole 42 may be created somewhat larger in diameter than 110% to 115% of the diameter of the product pipe 14—though generally not larger than 150% of that diameter. In conjunction with the increased annular clearance around the product pipe 14, the amount and nature of drilling fluid dispensed through nozzle (s) 406 may be adjusted to improve the supporting nature of the slurried soil cuttings for the positioned the product pipe 14. It may also be desirable to ballast the product pipe 14 to compensate for its positive or negative buoyancy within the drill slurry. These factors may be adjusted by commonly known admixtures and related principles and equations (not included herein).

It should be understood that the product pipe positioning assembly 500 depicted in FIG. 17 is one example of numerous ways that a conventional or guidable reamer assembly could be adapted for the selective radial positioning of product pipe 14 within the upsized borehole 42. For instance, the support member 302 arrangement of FIG. 14 could be adapted for this purpose by inserting an offset-allowing link—such as a double clevis arrangement—within its central shaft 304 approximately at the juncture between cutting member 38 and the support member 302. (The forward portion of the now two-part shaft 304 would be equivalent to the intermediate shaft 506 in FIG. 17.) The product pipe positioning feature may also be adapted for use with single-member drill string equipped conventional HDD backreaming systems.

The product pipe positioning assembly 500 may comprise a movable pipe positioning arm 508, one or more arm positioners 510 that may, for instance, be linear actuators, and the pipe pulling swivel 408 for connection to the pipe pulling cap 410 mounted on the leading end of product pipe 14. The swivel 408 may be fixedly attached to the distal end of positioning arm 508, as depicted in FIG. 17. Alternately, it may be built into pulling cap 410 or assembled between arm 508 and cap 410 by way of clevis-style connectors. One of the latter approaches may be preferred where side-loading of the swivel bearings is a concern. In any event, the length of arm 508 and the absolute angle of its articulation caused by the actions of arm positioners 510 determine the amount its distal end is offset radially from the central axis of intermediate shaft 506. The arm length and extension-retraction capability of the arm positioners 510 are purposefully sized to hold the range of motion of the distal end of arm 508 within the confines of the diameter of an outer ring 512. More preferably, its motion will be further limited or controlled such that the point 514 for the product pipe 14 connection to the distal end of arm 508 lies on or within a circle of diameter approximately equal to that of borehole 42 reduced by the outer diameter of product pipe 14.

The location of point 514—the amount of its offset in a particular radial direction from the centerline of borehole 42—defines the line of axial pull applied to the leading end of product pipe 14. For on-grade and on-line placement of product pipe 14, the line of pull would desirably be along that alignment and remain so throughout the pullback installation of the product pipe 14, even when borehole 42 drifts somewhat off line. The above-described variable line of pull feature of the present invention makes this goal possible. Furthermore, in a borehole annulus filled of pipe-supportive slurry, a buoyancy-compensated product pipe 14 not subjected to off-axis pulling forces tends to remain substantially in the positions where its leading end was radially placed along the length of that annulus. The range of possible radial placement positions for the product pipe 14 within borehole 42 is indicated in FIG. 17 by the depicted location of pipe and by the phantom outline alternate placement location 516. At these extremes of placement, a certain amount of radial clearance is retained so that the lubricity the drill slurry provides along the outer surface of the product pipe 14 is not excessively diminished. Phantom placement location 518 indicates the central positioning of the product pipe 14 within borehole 42. (For improved clarity, only the top outline of the product pipe 14 is shown for the 516 and 518 alternate placement locations of the product pipe 14.)

The borehole enlarging and engaging surface 502 of reamer assembly 500 is axially connectable to the downhole end of the outer member 56 of drill string 20, for instance by way of threaded connection 522. Thus, the rotation of enlarging and engaging surface 502 is accomplished with and controlled by outer member drive group 76 (FIG. 3). The surface 502 may comprise cutters 520 trailed by an integrally-connected outer ring 512. The cutters 520 may be similar in construction to that of one of several commonly-known soil or rock backreamers. It may be utilized to cut the final diameter of borehole 42, or simply to further mix and condition the slurried cuttings within a borehole 42 pre-formed by other apparatus. The generally smooth-surfaced outer ring 512 supports the reamer assembly 500 within borehole 42. Because it also must react into the wall of borehole 42 the pipe positioning and pipe pulling actions of arm 508, outer ring 512 is of extended length to provide greater surface contact area. This purposeful construction limits any reactionary misalignment of surface 502 with respect to the central axis of borehole 42 to an inconsequential amount.

With continued reference to FIG. 17, the movable pipe positioning arm 508 may be pivotally supported at one end, for example by way of a universal joint 526 (hereafter referred to as a "u-joint") or other variable angularity-allowing devices. Since a u-joint does not limit angular motion to a single plane, two arm positioners 510 supportingly arranged a quarter circle (90°) apart around its axis may be utilized to stabilize and also control the deployment direction of positioning arm 508. (The partially sectional view of FIG. 17 prevents a second positioner being shown.) The point of pivotal support provided by u-joint 526 lies approximately on the central axis of borehole 42, and is preferably axially located within the envelope of surface 502. Furthermore, the point of support is held in fixed axial relationship to borehole enlarging and engaging surface 502 while being rotationally uncoupled from it. This may be accomplished by the attachment of the u-joint 526 to push-pull resisting bearingly supported intermediate shaft 506, which in turn is coupled to the inner member 58 (FIG. 2) of drill string 20 and inner member drive group 78. Being rotationally uncoupled from enlarging and engaging surface 502, the pipe positioning arm 508 may be held without axial rotation or, as sometimes desired, repositioned and held in a different rotational orientation by proper control of inner member drive group 78. An uphole or downhole brake (not shown) may augment the holding of a particular orientation, as well as to prevent accidental indexing. An orientation sensor, such as roll-sensing beacon 530 signal-emissively housed on or within pipe positioning arm 508, provides useful information toward this rotational positioning action. Rotational stops (not shown) may beneficially prevent the inner member drive group 74 from applying more than a fractional revolution of bi-directional (i.e., clockwise and counterclockwise) motion to intermediate shaft 506. Allowing more than partial revolution of the shaft 506 could detrimentally affect the routing (not shown) of actuating power and control signals to and from the arm positioners 510. The above-described 90°-arrangement of two arm positioners 510 substantially reduces or eliminates the need for partial rotation of shaft 506. Knowing the rotational orientation of shaft 506, the product pipe 14 may be shifted the desired amount of offset away from the center of borehole 42 in the desired radial direction with pipe positioning assembly 500 through geometrically-determined respective causal amounts of extension or retraction of the two arm positioners 510. The rotational orientation of shaft 506 is sensed by beacon 530, while the respective amounts positioners 510 are extended or retracted may be measured by one of several known displacement sensing techniques or by precise metering of power or fluid to each positioner. Alternately, rotational encoders may be employed to sense the dual-plane angular articulation of u-joint 526. By way of the information communicated from these sensors to control system 48 (FIG. 1), the central axis of the leading end of product pipe 14 may be held in approximate concentric alignment with borehole 42 or, when desirable, moved in one of many possible radial directions to positions laterally offset with respect thereto under manual or automated control, as previously indicated. The radial placement position of the line of pull applied to the leading end the product pipe 14 may thus be varied, whenever desired, as the pipe positioning reamer assembly 500 pulls it into newly created segments of borehole 42.

With reference now to FIG. 18, shown therein is the previously described HDD system 10 further comprising an in-pipe alignment-sensing system 600 for sensing the alignment being taken by product pipe 14 as it is drawn into place behind any one of the previously described reamer assemblies. For purposes of illustration only, reamer assembly 22 of FIGS. 1, and 4-9 will be used as an exemplary reamer assembly used with the in-pipe alignment system of FIG. 18. As illustrated in FIG. 18, the system 600 may utilize a commonly-known laser 602 and target 604 alignment-sensing system in conjunction with other features described herein. However, alternative alignment-sensing systems including the video image of an optical alignment system such as a "theodolite", or similar systems could be employed without departing from the spirit of the invention. The system 600 may be utilized to validate, in an MWD manner, that the product pipe 14 is being properly placed along the critical-alignment section 606 of borehole 42, while providing another (or alternate) feedback source useful for directing actions of the other apparatuses to successfully achieve the desired alignment for the product pipe 14.

The alignment-sensing system 600 comprises a laser targeting arrangement 608 within product pipe 14 and an above-ground communications relay system 610. The communications relay system 610—by way of a wireless radio link 612, or another suitable communications technique—bi-directionally exchanges information 614 with control system 48 of HDD system 10. System 600 may also communicate with walkover monitoring system 44 (or alternative navigations systems for the reamer assembly). For convenience or where communications are distance or obstruction limited, monitoring system 44 may be utilized to relay information 46 between system 600 and control system 48, in addition to the information 46 already being interchanged.

Communications relay system 610 supplies command signals and power to the in-pipe laser targeting arrangement 600 by way of the extendable/retractable power and communications cable 616. Cable 616 conveys on-line or off-alignment signals created by laser targeting arrangement 608 and other useful information uphole for relay to the controls 48 of HDD system 10.

The laser targeting arrangement 608 may comprise a laser tractor 618 (or other alignment device) with tracked (or wheeled) undercarriage 620 and the receiving target 604. The laser 602 supported on laser tractor 618 emits a beam 622 intended to impinge upon receiving target 604. The target 604 is positioned at the leading end of product pipe 14—for example, mounted to pipe pulling cap 110—such that its receiving surface is substantially perpendicular to and centered on the central axis of the product pipe 14. Alternately, the placement of target 604 and laser 602 could be interchanged. Distant from target 604, the laser 602 is supported on laser tractor 618 in such a manner to cause laser 602 to emit its beam 622 from the approximate center of the product pipe 14. This may be accomplished by an adjustable height tractor 618.

Figure 19:
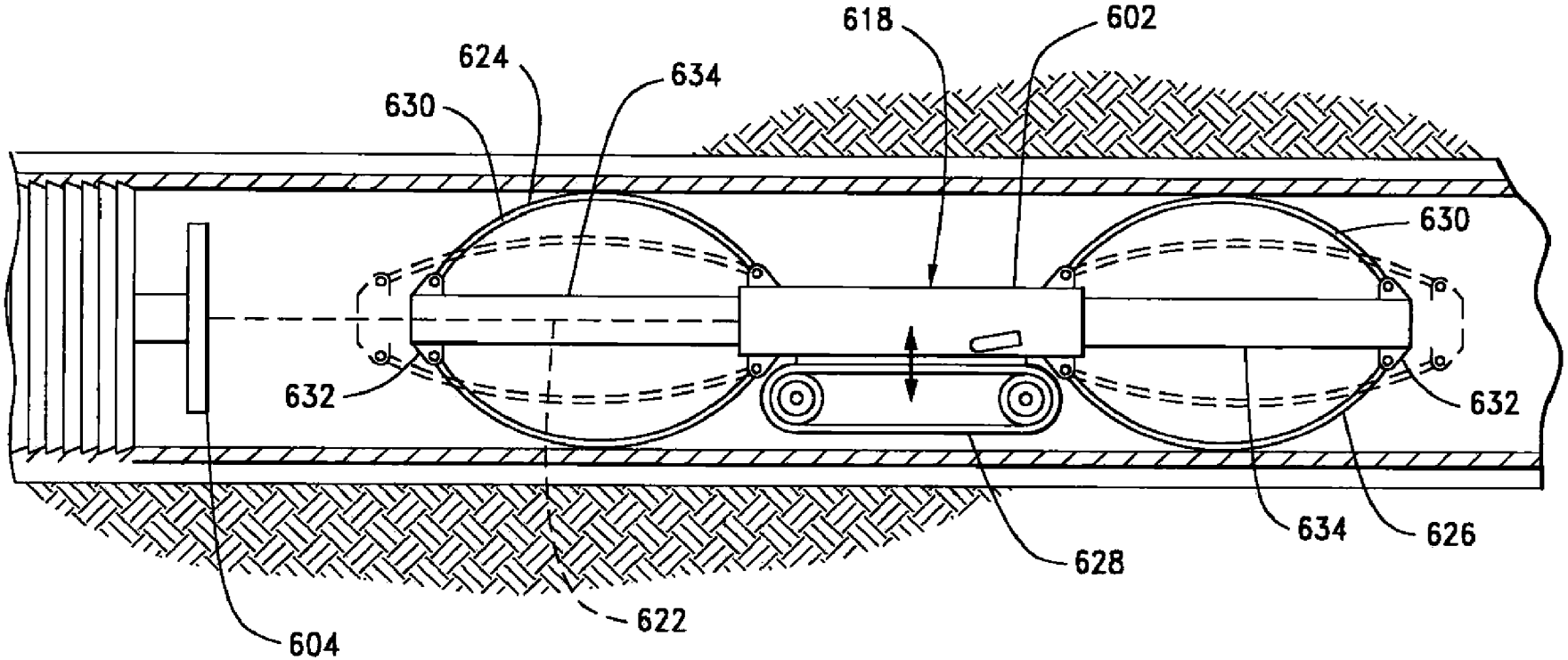
FIG. 19 is a close-up diagrammatic view of the laser guidance system of FIG. 18.

Referring now to FIG. 19, the tractor 618 is preferably equipped with deployable fore and aft centralizers 624 and 626 that lift its tracks 628 away from contact with the product pipe 14 while aligning the laser 602 with the product pipe's 14 centerline. The vertical double-ended arrow indicates the lowering of tracks 628 back in contact with the product pipe 14 when the centralizers 624 and 626 are undeployed. Although inflatable centralizers and other forms of adjustable centralizers would also be suitable, centralizers 624 and 626 are illustrated as being of the well-known deployable "bow spring" type. This type of centralizer may have three to five bow springs 630 that, when deployed, contact the interior wall of the product pipe 14 at the midpoint of their length. The bows 630 are spaced fore and aft sufficiently, and may be arranged radially, to avoid interference with tracks 628 and other portions of laser tractor 618. Deployment of the bow springs 630 into contact with the product pipe 14 involves their radial expansion by reduction of the distance between their end caps 632. This may be accomplished by one or more commonly known techniques, for example, by an electrically-powered ball screw (not shown) axially located behind the aft centralizer 626 or within its central tubular member. The central tubular member 634 of one or both centralizers may be telescopic in length. In certain arrangements, axial compression springs at either end of fore centralizer 624 (or other suitable means not shown) may insure its deployment in tandem with the aft centralizer 626. Irrespective of the technique utilized to deploy the fore centralizer 624, the core of its central member 634 intentionally remains hollow to allow passage of laser beam 622. For smaller diameter product pipes 14, it may be advantageous to utilize a single, lengthier centralizer surrounding laser tractor 618—e.g., one with bow springs 630 having sufficient axial stabilizing contact length with the interior of the product pipe 14. By proper design of the bow spring 630 contact surface with the interior of the product pipe 14 and, if necessary, with addition of lubrication to this interface, the product pipe 14 is not unduly restricted from sliding past the centralized laser tractor 618 when the latter is earth anchored in the manner yet to be described.

Similarly to those laser levels utilized to layout gravity-flow surface drainage applications, the alignment of laser beam 622 may be adjusted, as necessary, so that its projection toward target 604 is along the desired on-grade placement heading for product pipe 14. This adjustment feature is advantageous toward bringing product pipe 14 onto the desired course should it enter the horizontal section of borehole 42 somewhat out of alignment. If the product pipe 14 were on-course, the so aligned laser beam 622 would be substantially in coincidental alignment with the central axis of the product pipe 14 and would centrally impinge target 604.

Returning now to FIG. 18, it will be understood that product pipes 14 installed by the HDD process are typically made from materials such as polyethylene (PE), polyvinyl chloride (PVC), or steel. It is further understood, however, that even when made of steel, such pipes cannot be infinitely rigid against bending forces. Therefore, an offset applied at its leading end induces a bend along the central axis of the product pipe 14 that diminishes with distance to a point of tangency with its prior alignment. Movement of guidable reamer assembly 22 off the desired on-grade alignment for borehole 42 may induce such an offset at the leading end of the product pipe 14. With respect to the laser targeting arrangement 600 of FIG. 18, the "bent" pipe axis diverges from the "straight" laser beam 622, causing the beam to impinge target 604 non-centrally. This effect can be converted into useful information.

Although other arrangements are contemplated, target 604 preferably is a commonly known "active" receiver of the beam 622 emanating from laser 602. The target 604 may further comprise batteries and a wireless communications link to a receiver-transmitter (not shown) on laser tractor 618 and/or directly to the monitoring system 44 at the ground surface. Alternately, an additional extendable/retractable segment (not shown) of power and communications cable 616 bridges the distance between them. An "active" receiving surface, for example, may be comprised of numerous cells or grid-like areas (not shown), each sensitive to direct impingement of the narrowly-focused light beam 622. In that manner, it may readily be determined whether the beam 622 is in central alignment with the target 604—and, if not so aligned, determine the amount and direction of its misalignment. To determine the absolute (Earth reference) direction of misalignment it is helpful to know the "roll orientation" of the receiving surface about the central axis of borehole 42. Therefore, any axial twisting actions the leading end of the product pipe 14 may experience as it enters and advances along borehole 42 should be compensated for, or otherwise counteracted at the target 604. The twisting action may be physically counteracted by purposeful design of a spin-stabilized mounting. That is, the target 604 may be mounted in a manner that maintains its receiving surface at a given earth-referenced roll orientation. As known in the art, this may be accomplished in an active or passive design. For instance, target 604 may be pivot-mounted with respect to the central axis of pulling cap 110 (FIG. 4) in a pendulum-like arrangement, such that an earth-referenced roll orientation is held by the influence of gravity. Alternately, a fixed mounting may be utilized, with a roll sensor to provide information useful toward a software compensation for pipe twisting. This would, in essence, spin stabilize the receiving surface mathematically, for instance by timely re-assignment of its cell/grid position addresses.

A suitable strength tension member within the cable 616 (or adjacent thereto) tethers the laser tractor 618 to Earth anchor 26, when so desired. This anchor 26 is positioned near the distant end of product pipe 14—which, in HDD applications, is typically laid out above-ground in a continuous length, or 2-3 long segments where space is limiting, prior to the initiation of its pulled-in installation. The anchored tether 616 holds the laser tractor 618 portion of laser targeting arrangement 600 at one or more selected locations along the critical horizontal segment 606 of borehole 42. That is, once coupled to the anchor 26, the centrally-stabilized laser tractor 618 slides within product pipe 14 as the product pipe is pulled into place. The first earth-tethered location for laser tractor 618 may preferably be at the point where the pipe first reaches its desired on-grade alignment—i.e., after the leading end of product pipe 14 has entered the horizontal section 606 of borehole 42. Appropriate on-board navigation sensors, such as a beacon (not shown), may be utilized to determine when the laser tractor 618 has reached this anchor point, or another one later assigned. To position laser tractor 618 at the desired point, it may be driven down the pipe interior on its tracks 628 or wheels. Alternately, to obtain useful information during the borehole entry portion of the product pipe 14 pull-back, the centrally-stabilized laser tractor 618 may be temporarily tethered to cap 110 at a given distance from target 604. When the pull-in of the product pipe 14 has advanced the laser tractor to the desired earth-tether point, release of the temporary tether may be accomplished, for example, by an electromagnetic or mechanical disconnect or break-away. Alternately, centralizers 624 and 626 may be over-deployed to provide the temporary tethering. The above-described anchored tether 616 is then deployed to hold the laser tractor 618 at this location.

At extended range, laser beam 622 may begin to show divergence from its narrow focus. Heat and the localized atmosphere within the product pipe 14 may further degrade the beam 622. Thus, for long installation lengths of product pipe 14, it may be desirable to move laser 602 forward, toward target 604, one or more times after pull-back has progressed a substantial distance. The laser tractor 618 advantageously makes this practical. The laser tractor 618 may temporarily be untethered from anchor 26 and, after undeployment of its centralizers 624 and 626, driven to a new location within the product pipe 14, in closer proximity to target 604. Such repositioning capability also allows laser targeting arrangement 600 to be useful for on-grade pipe installations with alignments that are curvilinear within their on-grade plane. The laser tractor 618 may be moved forward whenever pull-back along a lateral curvature of borehole 42 has progressed to the point that laser beam 622 is impinging the left or right-most receiving elements of target 604. The new position of the laser tractor 618 is then determined with the aid of its on-board navigation sensors (not shown). Alternately, the tractor 618 may be driven to a preferred station within the product pipe 14 with the aid of these sensors. The tractor 618 provides other useful capabilities, such as: reinstatement after removal for repair, and to traverse its (or another) navigation system through the newly installed product pipe 14 for a full-length confirmation survey of location and alignment.

Not withstanding the above-described in-pipe laser alignment-sensing system 600, those skilled in the art of horizontal directional drilling appreciate that location and orientation indicators from a number of other navigation tracking systems may be utilized to verify whether a reamer assembly is creating upsized borehole 42 along its desired course. Such indicators are also useful toward the control of a guidable reamer assembly so that it maintains the proper path. In some situations, singular indicators are sufficient. For instance, determination of the need for an up or down (12 o'clock or 6 o'clock) steering correction could be substantiated solely by measuring the depth of reamer beacon assembly 40 with monitoring system 44 and relating this information to a reference surface elevation for comparison to the desired course. However, the required steering actions are often more complex than this example. Utilization of several indicators in combination provides improved control along the full length of borehole 42. In the preferred embodiment, shown in FIG. 1, the monitoring system 44 receives sensor data from the beacons 36 and 40 and communicates that information to the main control circuit 48, where determinations about the location and orientation of the reamer assembly with respect to its desired location and orientation can be made. Alternately, comparison to the desired path may be accomplished within monitoring system 44 and control signals comprise information 46.

The location information provided during the backreaming operation is often most advantageous to the owner of the product pipe 14 installed in the borehole 42. Location and orientation information communicated 46 and/or 614 from the navigation tracking system can also be utilized for the automated control of the guidable reamer assembly 22 to create the desired placement path for product pipe 14. Various alternatives to using radio frequency transmissions are available for communicating the location and orientation information to the machine control system 48, such as extending a wire line through the length of the drill string 20, communicating the information sonically through drilling fluid or the earth.

The control system 48 pulls the drill string 20 back through the borehole 16 by operating the various functions of HDD system 10. The control system 48 controls the rotation and pullback of the drill string 20 through the borehole 16, while the tracking system monitors and communicates the location and orientation of the reamer assembly. The actual location and orientation can then be compared to the desired path of borehole 42, to determine whether it is within a predetermined tolerance of the desired path. The desired path can be represented as a series of bore segments connected at direction change points. At a direction change point, the reamer assembly is redirected so that it may then follow the next bore segment. The process of automatically reaming along the desired bore path thus can be a repetitive process. When the reamer assembly or product pipe 14 veers from the desired bore path or as the bore path calls for a change in direction, the control system 48 will operate to change the direction of the guidable reamer assembly 22 to guide it along or back to the desired bore path. Similarly, the control system 48 can deploy the product pipe positioner 504 of reamer assembly 500 as the need is indicated. The control logic for the control system 48 comprises a plurality of routines designed to operate the HDD system 10 and steer the reamer assembly 22 or product pipe 14 along the desired bore path 16. The operation may be complemented with error-feedback loops to correct any errors in the operation of the HDD system 10 or deviation from the desired bore path. As used herein, "actual path" or location will be understood to mean the estimated path or location as determined from the available information.

For example, the critical control section 606 (FIG. 18) may have an undesired deviation along the bore 16, such as depicted at position 140 of FIG. 9. As the guidable reamer assembly 22 approaches to within 50 cm or so of deviation 140, the control can then begin to make the appropriate deployments in order to counteract the coming variance and achieve the desired alignment after upsizing borehole 16 to borehole 42. Similarly, the product pipe positioner 504 of the reamer assembly 500 can be deployed for this purpose.

Figure 20:
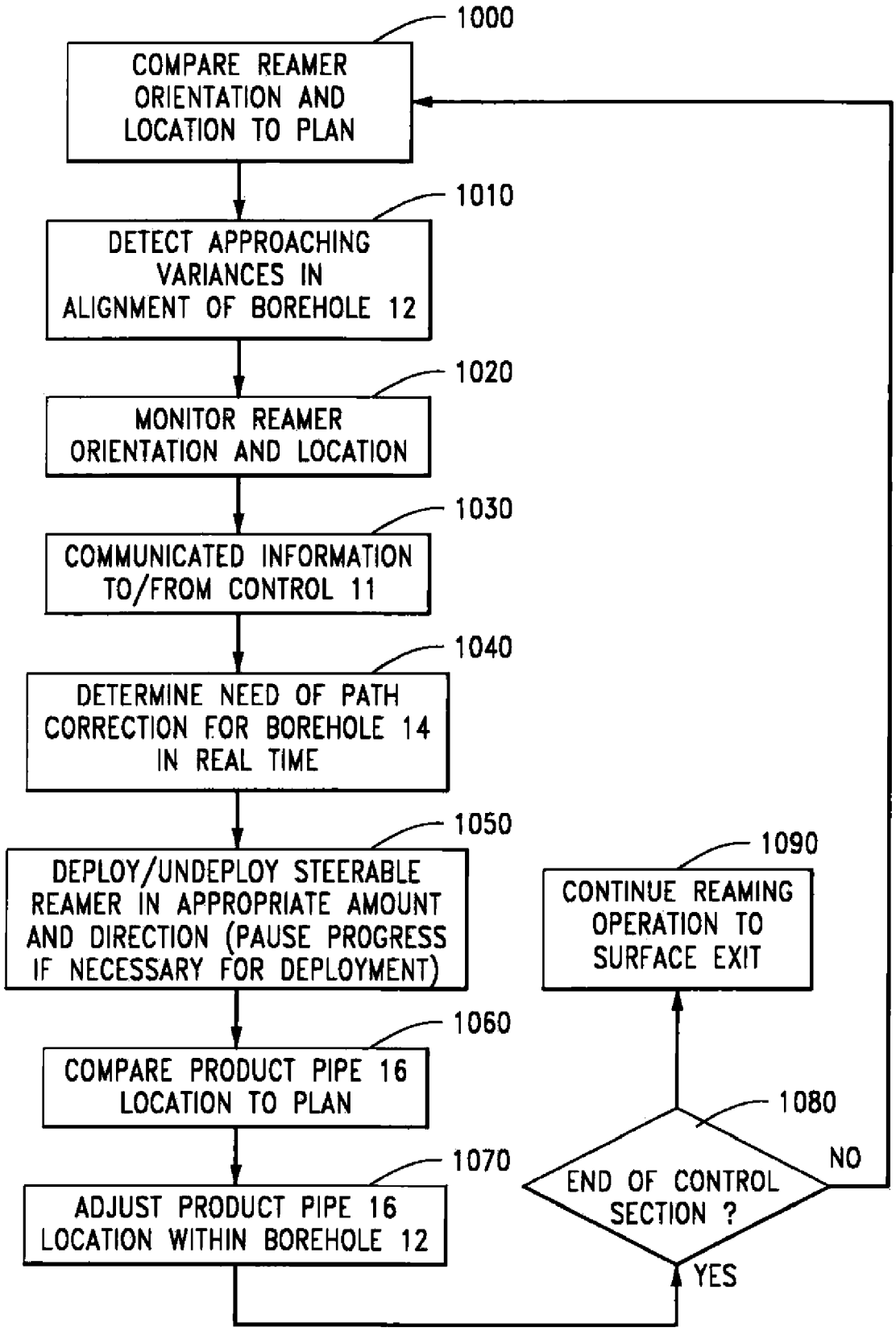
FIG. 20 is a flow chart illustrating control logic for placement of the product pipe with the guidable reamer assemblies of the present invention.

A basic flow diagram for the steps involved in making steering decisions during the reaming and the product pipe 14 installation process is illustrated in FIG. 20. Other variations in control logic are contemplated as being suitable for this purpose as well. The operative entry point 1000 to the given diagram begins once the guidable reamer has reached, and is upsizing, the critical control section 606 of borehole 16. First, the current orientation and location of guidable reamer assembly 22 is compared to the plan to determine if there is a variation between the desired path and the current location. Next, at step 1010, the borehole 16 is checked for any approaching variations. In the manner previously described with respect to FIGS. 1 and 9, the existing path of borehole 16 may not coincide exactly with the desired alignment of borehole 42. FIGS. 9*a* and 9*b* illustrate this undesired variation at deviation 140, which will hereafter be referred to as an "approaching variance" 140, as if the earth were moving toward the guidable reamer assembly 22.

An approaching inconsistency or variance 140 may be foretold by previously described sensors within centralizer 32, or by analysis of historical data on the alignment of borehole 16. One method of utilizing historical data is to compare a recorded "as-drilled" map of borehole 16 with the current position of the reamer assembly. If a map of borehole 16 was produced during the drilling operation, then an approaching variance 140 can alternately be detected by comparing the position of the guidable reamer assembly 22 along the borehole 16 with the next known inconsistency on the map. In other words, the earth entry point of drill string 20 in front of the rotary drive system 18 is shown on the map of borehole 16 and the present position of the guidable reamer assembly 22 may be plotted with respect to the borehole 16, creating a diagrammatic representation of the on-going operation depicted in FIGS. 1, 9 and 18 for comparison to the desired location of borehole 42.

The position of the guidable reamer assembly 22 can be located on the map by knowing one or more of several parameters, for instance, by the length of drill string 20 presently remaining within borehole 16. The length of drill string 20 may be derived by sensing the current location of the carriage 28 along the frame 24 of the rotary drive system 18 while keeping track of the number of drill pipe segments 54 connected to the rotary drive system 18. For example, the position of the carriage 28 may be monitored by correlating its movement to the operation of the hydraulic motor (not shown) or other device utilized to move carriage 28 and thereby thrust or pull the drill string 20 through the earth. Magnetic pulses from the motor can be counted by a speed pickup sensor (not shown), and the direction and distance the carriage 28 has traveled can be calculated. An additional sensor or switch (not shown) can be used to indicate when the carriage 28 has passed a "home" position. The magnetic pulses counted from the motor can then be used to determine how far the carriage 28 has traveled from the home position. One skilled in the art will appreciate other methods for tracking the carriage 28 are also possible, such as photoelectric devices, mechanical devices, resistive devices, encoders, and linear displacement transducers that can detect when the carriage 28 is in a particular position. When the carriage 28 has reached the back end of its travel, the control system 48 reduces the length of drill string 20 by the length of one drill pipe segment 54. Alternately, on a rotary drive system 18 equipped with a mechanized, automatically-controlled drill pipe handling device (not shown), the number of pipe segments 54 being returned to (or exiting) the pipe loader magazine may be tracked. For example, switches or photoelectric devices can be used to detect the passage of a drill pipe segment 54 into (out of) the pipe loader magazine. At each operational cycle of the pipe loader, the count of pipe segments 54 within borehole 16 is decremented (incremented) by one. When determining the length of drill string 20 within borehole 16, factors such as variations in lengths of drill pipe segments 54 or movement of the rotary drive system 18 can be compensated for, as appropriate, by the control system 48. For instance, the anchoring system 26 may allow the onset of reactionary movement of the rotary drive system 18 under high pullback load situations. Movement of the rotary drive system 18 can be sensed, for example, by an optical sensor or other motion sensor deployed to detect movement relative to the earth, or by a stringline potentiometer connected to a stake driven in the earth.

Turning back now to FIG. 20, if indicating options are not available for advance detection of the approaching variance 140, the inconsistency may be detected upon its engagement through the monitoring (step 1020) of the guidable reamer assembly 22 orientation and location. The monitoring at step 1020 is also useful to detect when guidable reamer assembly 22 may begin drifting off course because of gravity or other influence. (Obviously, such effects are not detectable with the "as-drilled" map or advance variance detection methods described above.) For on-grade applications, at least the pitch orientation of certain elements within the guidable reamer assembly 22 is monitored. It may also be desirable to create a borehole 42 with close-tolerance left-right alignment. This may be accomplished utilizing the above-described in-pipe alignment-sensing system 600 or through the monitoring of azimuth orientation, for instance by the inclusion of yaw sensors within the beacons 36 and 40—as described previously.

For the deployment of the steering feature, it may—as earlier described—be important to monitor the roll orientation of certain elements within the guidable reamer assembly 22. The spatial coordinates of the reamer location are comprised of position (x,z) and depth (y). Position "x" along the borehole 16 and depth "z" may be particularly useful in comparing the present path to the desired path. A step-wise pitch calculated from the depth readings of beacon assembly 40 or 36 could also be used to infer the proper grade is being maintained. The readings of an in-pipe laser alignment-sensing system 600 directly provide this "on-grade" verification. Other position and orientation sensing techniques known in the art could be adapted for these purposes as well.

As depicted at step 1030, information measured at steps 1000-1020 is communicated to automated control system 48 of HDD system 10. (This transfer of information has previously been described with respect to FIGS. 1 and 18.) Information is also communicated at other points within the diagram of FIG. 20—including those signals issued by control 48 at step 1050, for the purpose of controlling the various previously described functions useful in deploying or undeploying the guidable aspect of the previously described guidable reamer assemblies. The need of deployment is determined MWD at step 1040 in real time; i.e., rapidly enough to be considered so in relation to the advance rate of the guidable reamer assembly. Deployment is considered necessary whenever the one or more elements of location (x,y,z) or orientation (pitch, yaw) are found to be out of tolerance in comparison to the same respective parameters of the desired path for borehole 42 or product pipe 14. For instance, one may desire to place product pipe 14 at an on-grade slope (pitch) of 0.6% within a tolerance of ±0.1%. The first indicator of the guidable reamer assembly itself beginning to drift off course might best be detected by monitoring the parameter of pitch, for instance with the aid of beacon assembly 40. However, tolerances on location will likely have to be adhered to as well, especially where product pipe 14 has predefined coordinates for its terminal ends or lateral connections. Adherence to such multi-faceted requirements is made practical by the reamer assemblies of the present invention in association with appropriate sensors and decision/control algorithms.

The decisions made at step 1040 create control signals for activation/deactivation of the guidable feature(s) of reamer assemblies or the product pipe 14 positioning feature of reamer assembly 500, the mechanics of which were previously described. Once appropriately deployed (step 1050), the series of locations and orientations of the advancing guidable reamer assembly may be compiled into a growing set of information useful, over successive loops through steps 1000-1050, in predicting its eventual successful return to the desired path. That portion of feedback loop 1030-1050 stepwise modifies the amount of deployment (i.e., steering), for instance on a distance-advanced basis, to smoothly and efficiently hold borehole 42 on, or return it to, the desired alignment. The control loop of FIG. 20 continues to monitor the current position of the guidable reamer assembly and execute the necessary deployment or undeployment measures while the reamer assembly is in the critical control section 1092 of the borehole 42.

Still in reference to FIG. 20, the dashed outlined steps 1060 and 1070 would be applicable when a beacon assembly or an in-pipe alignment system 600 is incorporated into HDD system 10. Step 1060 may be utilized to provide feedback control to the product pipe 14 positioning assembly 504. When positioning assembly 504 is not present, step 1060 may be utilized to provide oversight to the control loop 1000-1050 for the guidable reamer assembly. At step 1080 the position of guidable reamer assembly is checked to see if it has advanced beyond the critical control section of borehole 42. For example, the above operations repeat until the critical or on-grade horizontal section of borehole 42 has been completed. At step 1090, reaming and pullback operations continue until the product pipe 14 reaches a desired subsurface termination point or surface exit. It is also to be understood that this control logic can be used in conjunction with control of other items on the rotary drive system 18, including, but not limited to, automated drill pipe makeup and breakout and automated control of the drilling operations. A more detailed description of these operations is included in commonly held U.S. Pat. No. 6,179,065 and application Ser. No. 09/481,351, the contents of which are incorporated herein by reference.

Figure 21A:
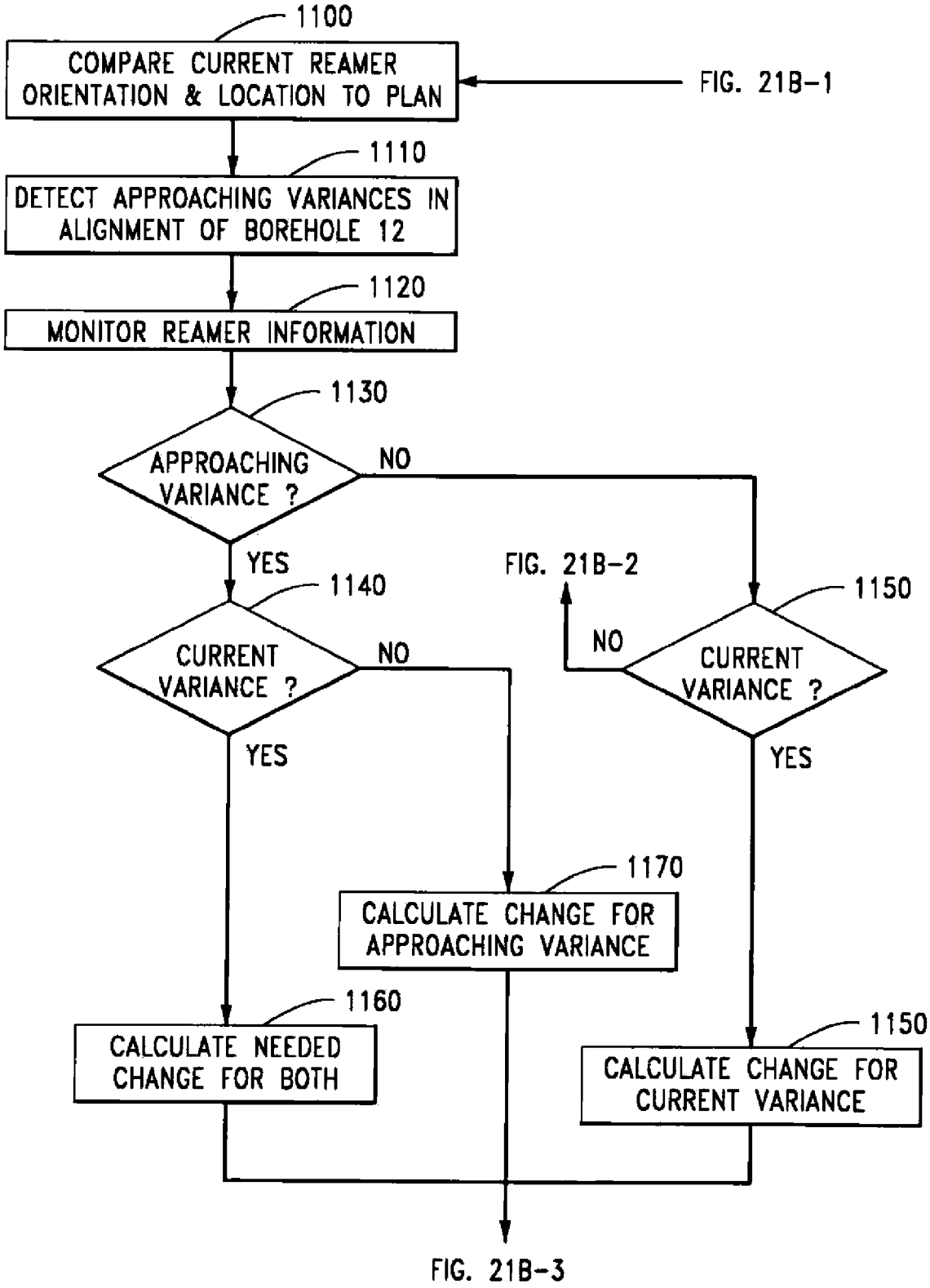
FIG. 21A-B are flow charts illustrating steps followed during automated placement of a product pipe with the guidable reamer assemblies of the present invention.
Figure 21B:
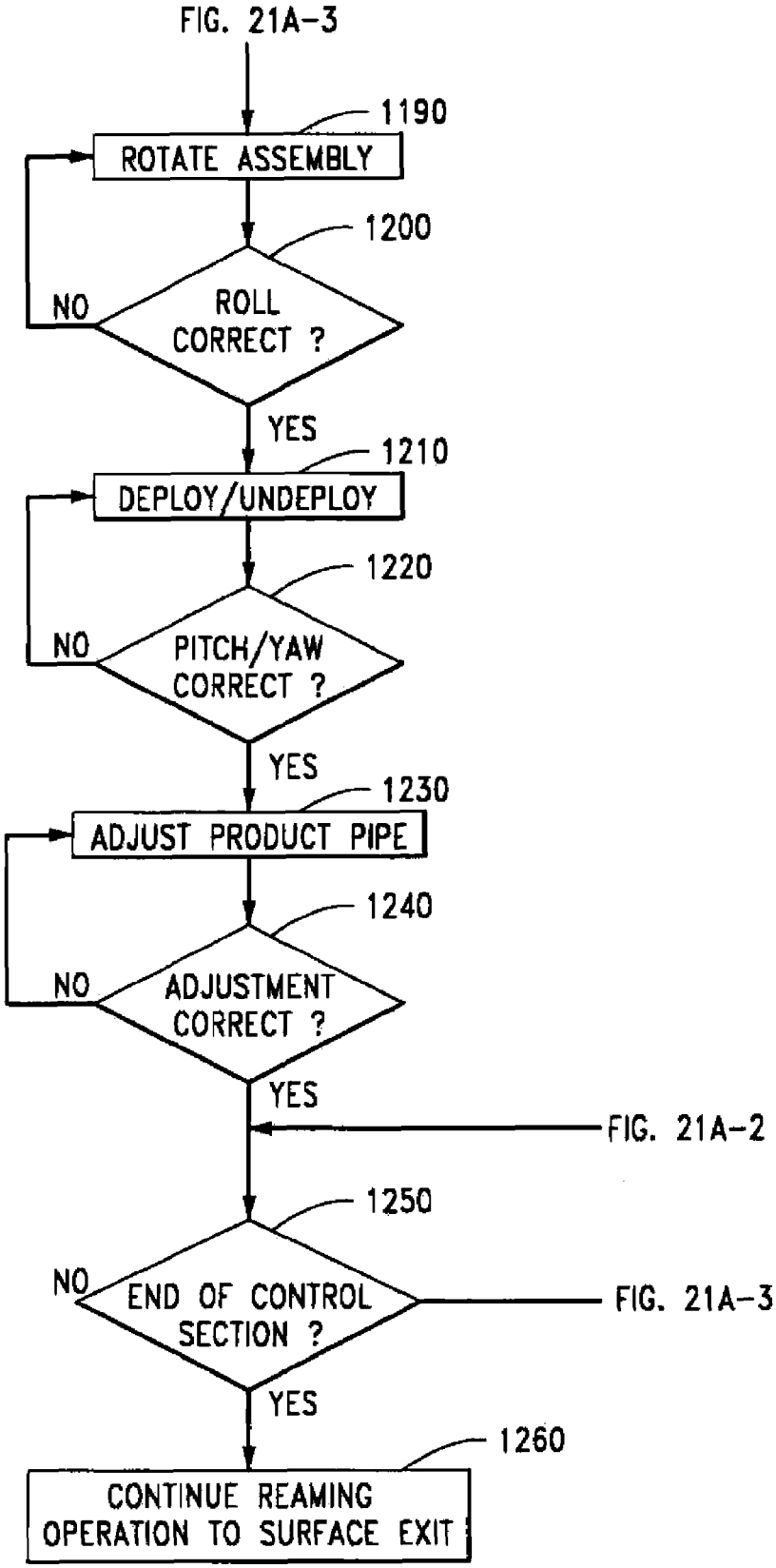

A more detailed control logic diagram for the guidable reamer assembly is shown in FIGS. 21A-21B. This logic diagram shows representative decisions and control loops used to automatically operate the guidable reamer assembly. The first three steps 1100, 1110, and 1120 are the same as the first three actions in FIG. 20. At step 1130, the control 48 first determines if the guidable reamer assembly is approaching an undesirable variance or deviation 140 in borehole 16. As stated previously, his determination may come from a detection of one or more of the sensors in or in front of the guidable reamer assembly or from comparing the as-drilled map of the borehole 16 (if available) with the current position of the guidable reamer assembly. An undesirable variance 140 noted on the as-drilled map of borehole 16 may, for instance, begin to become relevant toward steering deployment when it has approached to within ≦50 cm of the guidable reamer assembly. Once an approaching variance 140 has been detected, the control 48 next checks—at step 1140—whether there is a current variation from the desired orientation and/or position of the guidable reamer assembly. Any current variation may be indicated by one or more of the on-board downhole beacon assemblies along with the positional location of guidable reamer assembly. Even when any approaching variance 140 is beyond the range of its detection, that same information is checked on the other logic branch at step 1150.

After checking for any current variation from the desired orientation and/or position of the guidable reamer assembly, the control 48 has four options. If a YES is detected at step 1140, the control 48 calculates a change based upon both the approaching variance 140 and the current variation. The change necessary to counter an approaching variance 140 could be calculated by simply taking the expected or measured variance in pitch or yaw and dividing it in half, representing the amount of opposite way counteraction need from the steering feature of the guidable reamer assembly. Similarly, the change needed to counter a current variation could be calculated with a simple proportional control based on the variation. Obviously, other control techniques for PID loops, fuzzy logic, and other associated control methods could be used as well, and are contemplated. If the condition of both an approaching variance 140 and a current variation does not exist, then the appropriate calculations are made for the single change at steps 1170 and 1180. If there is neither an approaching variance 140 nor a current variation detected at step 1150, then control jumps to step 1250.

After the required change is calculated for deployment or undeployment of the steering feature of the guidable reamer assembly, the control 48 goes through several checks in order to produce the desired result. First, at step 1190, the control 48 rotates the deployment mechanism to the correct roll position, if it is required. This position is checked at step 1200 and looped back to step 1190 until the appropriate position is reached. Obviously, if roll orientation were not needed for a particular deployment, this portion of the diagram would be skipped. At step 1210, the proper action to deploy or undeploy the guidable reamer assembly is then started. The reactionary movement of the guidable reamer assembly is checked at step 1220 and control 48 loops back to step 1210 as necessary to ensure that the appropriate pitch, yaw, or other measurements are achieved before proceeding to the next step. When it is available, the product pipe positioning apparatus 504 is adjusted at step 1230 by the control 48. This is monitored at step 1240 and looped back again as necessary to step 1230. Finally, the position along borehole 16 is checked at step 1250 to determine whether the guidable reamer assembly is at the end of the critical control section 1092 of the borehole 42. If it is not, the control logic loops back to step 1100 to continue through the process. This procedure is done continually until the answer at step 1250 is YES. At this time, as was discussed with respect to FIG. 20, reaming and pullback operations continue until the product pipe 14 reaches a desired subsurface termination point or surface exit at step 1260.

Figure 22:
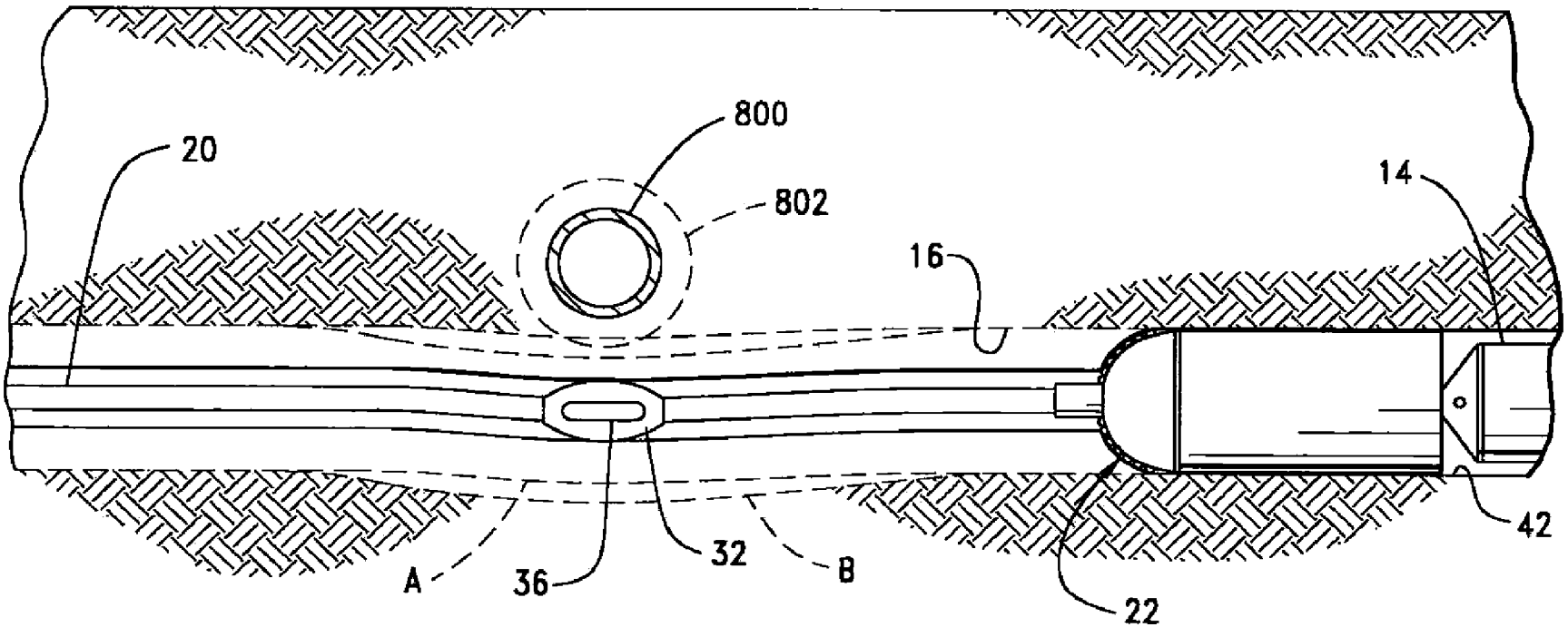
FIG. 22 is a diagrammatic representation illustrating the use of the guidable reamer assembly of the present invention to avoid an underground object.

Turning now to FIG. 22 the guidable feature of the previously described reamer assemblies may alternately be employed to direct a "non-critical alignment" borehole 42 around one or more known existing utility services or other obstacles 800 and their clearance (i.e., avoidance) zones 802. Depicted by path A, existing obstacles 800 lying closely outside the boundary of borehole 16 may be at risk of being intersected or otherwise damaged in the borehole upsizing process. Detecting this prospect before the arrival of the guidable reamer assembly is particularly advantageous since the reamer assembly is guidable. With this knowledge, the control system 48 of HDD system 10 can direct borehole 42 off the "path A" alignment of borehole 16 in a direction away from the existing obstacle 800 by proper deployment of the steering feature of the reamer assembly.

In FIG. 22, borehole 16 is depicted as passing under a known obstacle 800. However, this is not intended to be limiting. The obstacle 800 may be below or approximately alongside a portion of borehole 16, and multiple in numbers. From an as-drilled mapping of the borehole 16, for example, it may be determined that upsizing along the as-drilled path A alignment will cause intersection with clearance zone 802. The guidable feature of the guidable reamer assembly 22 can be appropriately deployed to avoid this undesired outcome in the creation of borehole 42. This may be accomplished at step 1110 in FIG. 21A by determining an "approaching needed variance" from the as-drilled map. In other words, a planned deviation (path B) from the as-drilled alignment (path A) is purposely initiated when that "approaching needed variance" is treated as if it were an approaching variance 140.

In the given illustration of FIG. 22, the guidable reamer assembly of the present invention would be steered to overcut toward the bottom of borehole 16 along an interval extending either side of obstacle 800. Control 48 would follow through the remainder of the FIGS. 21A and 21B logic diagram to activate the steering feature directed towards the bottom of borehole 16. Achievement of the desired amount of re-direction in borehole 42 may be verified by monitoring the position and depth of the reamer assembly, for example with the aid of reamer beacon assembly 40 (FIG. 1) in the manner previously described. After passing under the obstacle 800 and its clearance zone 802, the control 48 would not detect another approaching variance 140 (i.e., another obstacle 800) at step 1130. The control loop of steps 1150-1220 may then deploy the steering feature in the opposite direction and later undeploy it as borehole 42 returns to coincidence with the center of borehole 16.

Beyond the above described use of as-drilled mapping for obstacle avoidance during the upsizing of borehole 16, it should be noted that beacon assemblies 36 and 40 and monitoring system 44 may be configured for the early detection of certain types of known or unknown pre-existing buried utility services and other obstacles 800 in close proximity to the alignment of borehole 16. Because of the forward placement of beacon assembly 36, detection allows corrective action to be initiated before the reamer assembly reaches the location of concern. Detection may be accomplished, for example, by the impression of a known, active magnetic field on a conductive known existing utility 800 by an alternating current (AC) signal generator. A suitable AC signal generator may impress a signal within the frequency range of 1 kHz to 300 kHz. Some buried utilities, such as power cables, inherently emit AC signals suitable for detection. Such signals may be detected by inclusion of appropriate sensors within the beacon assembly 36. Once detected, the position of the unknown and known underground objects 800 can be determined, for instance in the form of a relative distance and an orientation angle of the objects with respect to beacon assembly 36. The same or similar sensors may be used to detect passive localized distortions in the earth's magnetic field caused by a near-by object made of, or containing magnetic materials. In most instances, the materials in question will be ferromagnetic. Such arrangements are disclosed in U.S. Pat. No. 6,411,094 "System and Method for Determining Orientation to an Underground Object", the contents of which are incorporated herein by reference. This object detection system (or other detection devices such as ground penetrating radar or acoustic reflection sensors) would be adapted for use during the reformation of the borehole into upsized borehole 42.

The object detection sensors of beacon assembly 36 comprise a magnetic sensor assembly (detection module) which may be adapted to detect magnetic field components from a localized passive magnetic field distortion caused by an object 800, or magnetic field components from an active magnetic field emanating from another object 800. The sensors of the detection module may measure, for instance, the three orthogonal components of the magnetic field at their locale. In a typical embodiment, the detected magnetic field component data are transferred through a multiplexer to an analog/digital converter and then to a processor. The data are processed by the processor to determine the "position orientation" of the detection module with respect to the object; i.e., distance and direction angle to the object if the application involves an active magnetic filamentary source. This information may then be transmitted by the beacon assembly 36 to the monitoring system 44 for display and/or rebroadcast for use in the control 48 of the HDD system 10.

Additional processing of the data may be necessary when the detection module does not lie in a horizontal plane due to the pitch and roll orientation of beacon assembly 36 at that particular point along borehole 16. For instance, the processor may use the pitch angle data and the roll angle data to compensate for those effects on the magnetic field component measurements and coordinate system transform the magnetic field component data measured by beacon assembly 36 to a consistent horizontal reference plane; e.g., a Cartesian coordinate system having a vertical y-axis. Where object 800 is a linear horizontal conductor on which a signal is impressed, the relative orientation of the beacon assembly 36 with respect to the conductor can be obtained by coordinate rotation between their respective Cartesian coordinate systems. The knowledge that an infinitely long current-carrying filamentary conductor has a zero magnetic field component parallel to the axis of the conductor aids in determining the rotation angle between the coordinate systems. Once the rotation angle is determined, transformation relationships may be used to convert the magnetic field component readings from the beacon assembly 36 coordinate system to the conductor 800 coordinate system. The distance between the beacon assembly 36 and the conductor 800 can be calculated utilizing a calibration constant and the known relationship between field strength and distance. The rotation angle then is used to determine if the beacon assembly 36 is approaching, paralleling, or departing the conductor 800—the conclusion reached by this analysis being verified by monitoring the indicated distance between the beacon assembly 36 and the conductor 800 over an interval of time. This is a repetitive process; a new determination is made for each sequential set of sensor measurements.

In the case of object 800 being the cause of a passive distortion of the earth's magnetic field, the local total magnetic field is computed from the magnetic field component readings of the detection module in beacon assembly 36. This value is compared to a reference value set-point for the earth's magnetic field, pre-determined by placing beacon assembly 36 in an area known to be unaffected by underground objects. The processor in beacon assembly 36 continuously accepts sensor signals from the detection module, computes the total magnetic field, and continuously compares the computed total magnetic field to the predetermined set-point. If the total magnetic field departs from the set-point by more than a designated tolerance, the out-of-tolerance condition is indicative of a possible impending strike of an underground object 800. To avoid the undesired outcome of a strike, the guidable feature of the guidable reamer assembly can be appropriately deployed to divert the borehole 42 around the object 800, as earlier described.

The present invention also comprises a method for reaming a borehole with a horizontal directional drilling system using any one of the previously described a reamer assemblies. In accordance with the present method, the previously described reamer assemblies comprise a cutting member having a central longitudinal axis and a support member also having a central longitudinal axis.

Having determined the need to ream the borehole 16, the selected reamer assembly is rotated and axially advanced along the borehole 16 to make an enlarged borehole 42. However, deviations 140 in the borehole 16 may be encountered thus necessitating the need to remove such deviations. Therefore, the method further comprises sensing a deviation in the borehole using any one of the previously described beacon assemblies.

Once the deviation 140 in borehole 16 is sensed, the reamer assembly is moved to a steering position where the longitudinal axis of the cutting member is laterally displaced relative to the longitudinal axis of the support member to remove the deviation from the borehole. The cutting member is axially advanced along the borehole 16 while laterally displaced and the deviation 140 is removed. After the deviation is removed, the reamer assembly is moved back to the non-steering position and the reaming process is continued.

Various modifications can be made in the design and operation of the present invention without departing from the spirit thereof. Thus, while the principal preferred constructions and modes of operation of the invention have been explained in what is now considered to represent the best embodiments, which have been illustrated and described, it should be understood that within the scope of the appended claims, the invention may be practiced otherwise than as specifically illustrated and described.

What is claimed is:

1. A guidable backreaming assembly for use in horizontal directional drilling operations, the backreaming assembly comprising:

a backreaming member having a central longitudinal axis;

a support member having a central longitudinal axis; and a steering assembly moveable between a steering position and a non-steering position and adapted to laterally offset the central longitudinal axis of the backreaming member from the longitudinal axis of the support member when the steering assembly is in the steering position.

2. The guidable backreaming assembly of claim 1 wherein the steering assembly comprises a means for selectively expanding the support member to engage an inner surface of a borehole.

3. The guidable backreaming assembly of claim 1 wherein the support member comprises a first borehole engaging member and a second borehole engaging member and wherein the first and second borehole engaging members are selectively movable relative to each other.

4. The guidable backreaming assembly of claim 1 wherein the steering assembly comprises a means for engaging an inner surface of a borehole.

5. The guidable backreaming assembly of claim 4 wherein the means for engaging the inner surface of the borehole comprises a plurality of borehole engaging members that are each selectively movable to engage or disengage the inner surface of the borehole.

6. The guidable backreaming assembly of claim 1 further comprising a first beacon supported by the support member and adapted to transmit information indicative of the position and orientation of the support member.

7. The guidable backreaming assembly of claim 6 further comprising a second beacon supported by the backreaming member and adapted to transmit information indicative of the position and orientation of the backreaming member.

8. The guidable backreaming assembly of claim 1 further comprising a processor assembly adapted to automatically move the steering assembly between the steering position and the non-steering position.

9. The guidable backreaming assembly of claim 1 further comprising a means for connecting a product pipe to the support member.

10. The guidable backreaming assembly of claim 9 further comprising a means for detecting an alignment of the product pipe relative to the guidable backreaming assembly.

11. The guidable backreaming assembly of claim 10 wherein the means for detecting the alignment of the product pipe relative to the guidable backreaming assembly comprises a laser targeting system supported partially by the product pipe and by the support member.

12. A horizontal directional drilling system used to make a generally horizontal borehole, the system comprising:

a rotary drive system;

a drill string having a first end and a second end;

wherein the first end of the drill string is operatively connected to the rotary drive system; and a backreaming assembly operatively connected to the second end of the drill string comprising:

a backreaming member having a central longitudinal axis;

a support member having a central longitudinal axis; and a steering assembly moveable between a steering position and a non-steering position and adapted to laterally offset the central longitudinal axis of the backreaming member from the longitudinal axis of the support member when the steering assembly is in the steering position.

13. The horizontal directional drilling system of claim 12 wherein the support member comprises a first borehole engaging member and a second borehole engaging member and wherein the first and second borehole engaging members are selectively movable relative to each other.

14. The horizontal directional drilling system of claim 12 wherein the steering assembly comprises a means for engaging an inner surface of a borehole.

15. The horizontal directional drilling system of claim 14 wherein the means for engaging the inner surface of the borehole is selectively movable to engage or disengage the inner surface of the borehole.

16. The horizontal directional drilling system of claim 12 further comprising a beacon supported by the drill string between the second end of the drill string and the backreaming member.

17. The horizontal directional drilling system of claim 16 wherein the beacon is adapted to detect the orientation of the drill string within the borehole.

18. The horizontal directional drilling system of claim 17 wherein the beacon is supported in a pipe section comprising a deflection member, wherein the deflection member is operable to steer the backreaming member in response to selective rotation and advance of the drill string.

19. The horizontal directional drilling system of claim 18 wherein the beacon is supported within the deflection member and usable to determine a location and an orientation of the deflection member.

20. The horizontal directional drilling system of claim 12 wherein the backreaming assembly comprises a means for a pulling product pipe into the borehole.

21. The horizontal directional drilling system of claim 12 further comprising a pipe alignment system operatively connected to the support member and adapted to sense the alignment of a product pipe connected to the support member.

22. The horizontal directional drilling system of claim 21 wherein the pipe alignment system comprises a laser targeting assembly disposed within the product pipe.

23. The horizontal directional drilling system of claim 22 wherein the laser targeting system comprises a tractor assembly adapted to support a laser emitting device and a laser receiving target positioned at a leading end of the product pipe.

24. The horizontal directional drilling system of claim 23 wherein the laser emitting device is supported by the tractor assembly at a center point of the product pipe.

25. The horizontal directional drilling system of claim 23 wherein the tractor assembly comprises a centralizer adapted to lift the tractor away from the product pipe to center the laser emitting device within the product pipe.

26. The horizontal directional drilling system of claim 12 further comprising a means for sensing deviation of the backreaming assembly from a desired borepath.

27. The horizontal directional drilling system of claim 12 further comprising a first beacon supported by the support member and adapted to transmit information indicative of the position and orientation of the support member.

28. The horizontal directional drilling system of claim 27 further comprising a second beacon supported by the backreaming member and adapted to transmit information indicative of the position and orientation of the backreaming member.

29. The horizontal directional drilling system of claim 28 further comprising a third beacon supported by a product pipe operatively connected to the support member, wherein the third beacon is adapted to detect the orientation of the product pipe.

30. The horizontal directional drilling system of claim 12 further comprising:

an orientation sensor supported by the backreaming assembly and adapted to detect an orientation of the backreaming assembly and transmit an orientation; and a processor assembly adapted to receive and process the orientation signal and automatically move the steering assembly between the steering position and the non-steering position in response to the orientation signal.

31. A method for steering a backreaming assembly within a borehole with a horizontal directional drilling system, wherein the backreaming assembly that comprises a backreaming member having a longitudinal axis and a support member having a longitudinal axis; the method comprising:

detecting the position and orientation of the backreaming assembly;

laterally displacing the longitudinal axis of the backreaming member relative to the longitudinal axis of the support member; and selectively rotating and advancing the backreaming member for a segment of axial advance.

32. The method of claim 31 further comprising:

selecting a desired grade to the borehole;

sensing an orientation of the backreaming assembly relative to the desired grade; and selectively rotating and advancing the backreaming member until the orientation of the backreaming assembly is substantially aligned with the desired grade of the borehole.

33. The method of claim 31 wherein the backreaming assembly comprises a steering assembly movable between a steering position and a non-steering position and wherein the laterally displacing step comprises moving the steering assembly between the non-steering position and the steering position.

34. The method of claim 31 further comprising determining a desired grade for the borehole.

35. The method of claim 34 further comprising:

detecting an alignment of a product pipe operatively connected to the backreaming assembly relative to the desired grade; and adjusting the alignment the product pipe relative to the backreaming assembly to substantially align the product pipe with the desired grade.

36. The method of claim 35 further comprising projecting a light beam along the centerline of the product pipe to a target disposed on the backreaming assembly to detect the alignment of the product pipe relative to the desired grade.

37. The method of claim 31 further comprising:

continuously detecting the position and orientation of the backreaming assembly relative to a desired borepath; and detecting a deviation of the position or orientation of the backreaming assembly from the desired borepath; and automatically displacing the longitudinal axis of the backreaming member relative to the longitudinal axis of the support member upon detection of the deviation.

38. A method of steering a backreaming assembly along a desired borepath with a horizontal directional drilling system, wherein the backreaming assembly comprises a backreaming member having a longitudinal axis and a support member having a longitudinal axis; the method comprising:

establishing the desired borepath;

selectively rotating and advancing the backreaming assembly along an actual borepath;

detecting the position and orientation of the backreaming assembly on the actual borepath relative to the desired borepath to determine a deviation of the backreaming assembly from the desired borepath;

automatically displacing the longitudinal axis of the backreaming member laterally relative to the longitudinal axis of the support member for a segment of axial advance of the backreaming assembly to return the backreaming assembly to the desired borepath.

39. The method of claim 38 further comprising automatically transmitting a control signal from the horizontal directional drilling machine to automatically displace the longitudinal axis of the backreaming member laterally relative to the longitudinal axis of the support member.

40. The method of claim 38 wherein the desired borepath comprises a desired grade.

41. The method of claim 40 wherein determining a deviation of the backreaming assembly from the desired borepath further comprises detecting a deviation of the backreaming assembly from the desired grade.

42. The method of claim 38 wherein detecting the position and orientation of the backreaming assembly comprises detecting a signal from a beacon supported by the backreaming assembly.

43. The method of claim 38 wherein detecting the position and orientation of the backreaming assembly relative to the desired borepath comprises detecting a plurality of beacon signals from a plurality of beacons supported by the backreaming assembly.

44. The method of claim 43 wherein the horizontal directional drilling system comprises a drill string adapted to support the backreaming assembly at a downhole end and wherein at least one of the plurality of beacons is supported in the drill string.

45. The method of claim 38 further comprising detecting an obstacle along the desired borepath and automatically displacing the longitudinal axis of the backreaming member relative to the longitudinal axis of the support member to steer the backreaming assembly around the obstacle.

* * * * *